US006896708B2

(12) United States Patent
Connor et al.

(10) Patent No.: US 6,896,708 B2
(45) Date of Patent: May 24, 2005

(54) SYNTHETIC JET FUEL AND DIESEL FUEL COMPOSITIONS AND PROCESSES

(75) Inventors: Daniel Stedman Connor, Cincinnati, OH (US); James Charles Theophil Roger Burckett-St. Laurent, Lasne (BE); Thomas Anthony Cripe, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 387 days.

(21) Appl. No.: 09/897,572

(22) Filed: Jul. 2, 2001

(65) Prior Publication Data

US 2002/0104779 A1 Aug. 8, 2002

Related U.S. Application Data

(60) Provisional application No. 60/182,382, filed on Feb. 14, 2000.

(51) Int. Cl.[7] ..... C10L 1/18
(52) U.S. Cl. ..... 44/451; 44/452
(58) Field of Search ..... 44/436, 451, 452; 208/15, 16, 17

(56) References Cited

U.S. PATENT DOCUMENTS 4,201,683 A * 5/1980 Brewster ..... 508/362
4,658,068 A 4/1987 Hanin
4,859,210 A * 8/1989 Franz ..... 44/436
5,324,335 A 6/1994 Benham et al.
5,488,191 A 1/1996 Chu et al.
5,504,118 A 4/1996 Benham et al.
5,506,272 A 4/1996 Benham et al.
5,621,155 A 4/1997 Benham et al.
5,645,613 A 7/1997 Benham et al.
6,447,557 B1 * 9/2002 Yeh et al. ..... 44/437

FOREIGN PATENT DOCUMENTS

EP 0 277 345 A 8/1988
WO WO 97 01521 A 1/1997

* cited by examiner

*Primary Examiner*—Cephia D. Toomer
(74) *Attorney, Agent, or Firm*—Laura R. Grunzinger; Kim William Zerby; Steven W. Miller

(57) ABSTRACT

Novel clean fuels comprising selected nonlinear long chain saturated primary monohydric/dihydric alcohols and mixtures thereof, novel diols; and processes for making clean synthetic jet fuels and/or clean synthetic diesel fuels as well as processes for making clean synthetic jet fuels and/or clean synthetic diesel fuels concurrently with making nonlinear alcohols for use by the detergent industry.

34 Claims, 7 Drawing Sheets

SYNTHETIC JET FUEL AND DIESEL FUEL COMPOSITIONS AND PROCESSES

CROSS REFERENCE TO RELATED APPLICATIONS

This application claims priority under 35 U.S.C. § 119(a) to International Serial No. PCT/US01/04693, filed Feb. 13, 2001; and further claims priority to U.S. provisional application No. 60/182,382, filed Feb. 14, 2000.

FIELD OF THE INVENTION

This invention is in the field of synthetic fuels, especially synthetic jet fuels and/or synthetic diesel fuels, and of processes for making them. More particularly the invention is in the field of low-sulfur or sulfur-free fuels comprising an additive to compensate for sulfur removal.

BACKGROUND OF THE INVENTION

Jet fuels or diesel fuels that are clean and contain substantially no sulfur, nitrogen, or aromatics are expected to be on the verge of a dramatic increase in demand, for example to meet the pressing need of automobile manufacturers for a global standard. See the testimony to the U.S. Congress of Oct. 5, 1999 by James A. Spearot, Director, Chemical and Environmental Sciences Laboratory, General Motors, on behalf of the Partnership for a New Generation of Vehicles Advanced Fuels Group. However there are substantial unsolved technical problems connected with such a development.

Certain quite recently developed fuel compositions are clean, but are seriously deficient in certain fuel-desirable technical attributes. These are, apparently, lost along with the removal of sulfur and/or nitrogen. Accordingly there is a newly emergent need, and corresponding thereto, a significant technical problem to be solved. This is: how to secure improved clean jet or diesel fuel which more effectively compensates for removal of sulfur and/or nitrogen and/or aromatics, especially for removal of sulfur.

Such novel fuels would comply with increasingly stringent regulatory standards, and would be highly sought after by the consumer both for their improved environmental acceptability, and for their lack of compromise in terms of effectiveness, especially for fuel system lubrication of injectors and fuel pumps, in modern engines.

Another growing need in the field of low sulfur jet/diesel fuels (including in general sulfur-free types) is the need for a common or "fungible", i.e., economically interchangeable, fuel/additive or fuel additive "concentrate". Such commonality would permit a relatively small number of specialized plants, such as Fischer-Tropsch plants, to serve as a source of supply of a "concentrate" which could be blended in any petroleum refinery with all manner of jet/diesel fuels, especially low-sulfur fuels, including hydrodesulfurized and/or biodesulfurized conventional petroleum fuels as well as Fischer-Tropsch derived fuels. Thus the benefit of the additive would be spread over all the principal ultra-low sulfur jet/diesel fuels, and solve for all of them the problems incurred by sulfur-removal. Such a benefit could indeed be material to the protection of the entire base of investment in conventional petroleum refining. Moreover, if the additive were to be a concentrate, the above need would be addressed much more viably and economically.

Unfortunately, known processes for making fuel lubricating additives of the relatively long-chain type required are subject to intrinsically producing too low a level of useful additive, diluted by hydrocarbons which are uneconomical to transport or to remove. Moreover, there is significant room for improvement in the properties of such additives.

Known processes for example include those which produce so called "native" alcohols in a Fischer-Tropsch derived fuel; such processes currently are lacking in having both an inadequate type and level of branching in the native alcohol. Moreover, the total amount of such "native" alcohols is insufficient when blending to high dilution for modern jet/diesel fuel lubrication. Further, in products of such processes, there is no independent variability of branching/heavy atom count in the alcohol as compared to the copresent fuel hydrocarbons, thus no possibility of concurrently optimizing (a) lubricity properties and (b) other important parameters, e.g., cetane number or smoke point. (Heavy atom count for hydrocarbon=sum of carbon atoms; heavy atom count for alcohol=sum of carbon and oxygen atoms).

Non-alcohol approaches to additives for low sulfur fuels have been tried and found wanting. State of the art, for example, is represented by WO 96/25473; WO 98/21293; WO 98/28383; WO 99/00467; and U.S. Pat. No. 5,488,191. Such additives have one or more important disadvantages, for example they contain nitrogen, aromatic rings, have overly high molecular weight, or are relatively uneconomical.

Particularly desirable, then, would be a common, concentrated, biodegradable, economical additive which is more lubricious. Ideally, such an additive would be less polar, and dramatically lower melting than any known additive currently available on commercial scale in concentrate form. Moreover, such a particularly desirable additive would be free from disadvantages such as excessively high molecular weight, and would completely and cleanly combust without any difficulty. Compositions comprising such an additive would permit independent control of the structure of the alcohols and the structure of the fuel hydrocarbons, for an overall optimization of the fuel properties of mixtures containing both.

Accordingly, it is an object of the present invention to secure such a concentrated additive, derivative low-sulfur- or zero-sulfur-fuels containing it, and processes for making it.

Processes for making jet and/or diesel fuels have been markedly improved in recent years. Such processes include deep hydroprocessing of crudes as well as recently improved Fischer-Tropsch slurry bed reactions to convert synthesis gas (syngas) to a wax, followed by hydrocracking/hydroisomerization and distillation to separate the desired fuel streams. The products can be optimized around jet/diesel.

The present invention substantially modifies such processes and compositions, affords novel fuel compositions, including the desired concentrated additive, and solves the aforementioned technical problems.

Compositions of the present invention have numerous advantages, for example in permitting a much greater flexibility for the formulator in producing finished fuels, or concentrated additive blendstocks which are clean, highly biodegradable, have superior lubrication properties, and can be pipelined or shipped as liquids under ambient or even arctic temperatures (e.g., −30 deg. F. or even lower).

The inventive fuels and processes permit independent optimization of the properties of fuel hydrocarbons and alcohols for overall superior results.

An especially important advantage is that the concentrated additives or "concentrates" of the invention separate much less readily from diluted blendstocks and/or finished fuels at low temperatures. This makes them highly desirable in a number of critical applications, including for use in jet fuel. Further, in preferred embodiments, the compositions are substantially olefin—free and carboxylate—free, thereby essentially eliminating peroxide forming tendencies and reducing corrosion/gum formation.

The present invention is accompanied by advantages useful not only to the manufacturers and consumers of fuels, but also to manufacturers and consumers of detergents, for example in that, by promoting the manufacture of selected alcohols for fuel uses, important economies of scale will make similar alcohols much more affordable for detergent uses.

BACKGROUND ART

The term "short chain" as used in conjunction with alcohols refers to alcohols having a carbon content of from one carbon atom to about 10 carbon atoms, to alcohol mixtures in which such alcohols predominate, or to branched alcohols in which the longest possible linear chain has no more than about 9 carbon atoms, such as 2-ethylhexanol or 2-propylheptanol. "Short chain" alcohols typically encompass plasticizer alcohols, but not alcohols of types commonly known as detergent alcohols.

The term "long chain" as used in conjunction with alcohols herein, refers to alcohols having a carbon content of from about 11 carbon atoms to about 21 carbon atoms, though in general when a distribution of chain lengths is present, a minor proportion in the tails of the distribution may lie outside this range and, when there is branching, more than 20 carbon atoms may in general be present. The term "long chain" can appropriately be applied to the essential alcohols (NLA alcohols) herein.

Alcohols in the art can have a very large variety of structures and include natural and synthetic types, linear-, branched- or cyclic-aliphatic monoalcohols, diols and polyols; and aromatic or heterocyclic alcohols including natural alcohols e.g., sugars and/or heteroatom-functional aliphatic alcohols such as aminoalcohols. Also there exist various commercial alcohols, such as the NEODOL® types commercially available from Shell, the EXXAL® types commercially available from Exxon, the ISOFOL® types commercially available from Condea, Ziegler alcohols, Guerbet alcohols, and others. In general, alcohols can be saturated or unsaturated and can be linear, or can have branches of a great variety of art-known types depending on the size and position of branching moieties or, in other terms, their analytical characterization (e.g., by n.m.r), their performance properties, or the process by which they are made.

As is the case with alcohols, hydrocarbons are known with an enormous variety of structures and substitution patterns. Hydrocarbons include crude oil and lubricating oils. The term "fuel" as used herein, for example in the phrases "fuel blend stock" or "finished fuel composition" or "fuel hydrocarbon" is a much more specific term than (unqualified) "hydrocarbon", and refers to a hydrocarbonaceous fluid suitable for combustion in turbine or non-turbine engines including internal or surface combustion engines, the internal combustion type in particular including jet and diesel engines.

Properties qualifying or permitting selection of hydrocarbons as fuel are extensively documented in the technical literature, see for example Kirk Othmer's Encyclopedia of Chemical Technology, 4th Edition, Wiley, N.Y., Volume 3, 1992, pp. 788–812 and Kirk Othmer's Encyclopedia of Chemical Technology, 4th Edition, Wiley, N.Y., Volume 12, 1994, pp. 373–388, and some of these properties are also easily appreciated by the non-technical person.

For example, it is well known that use of an improper hydrocarbon, such as a lubricating oil, as fuel, is accompanied at least by smoke and commonly, by catastrophic results for an improperly supplied engine. Likewise sugars are a type of relatively low molecular weight polyhydric alcohol. They are well known by pranksters as a source of damage to lawnmower engines if added to the fuel. From this it should be quite clear that there is enormous variation possible, ranging from the highly useful to the very deleterious, in the properties of various alcohols as they relate to fuel utility or lack thereof.

Some alcohols have generally been described in mixtures with hydrocarbons for a great variety of useful purposes. For example, short-chain alcohols such as methanol or ethanol have been mixed with gasoline for use in automobiles, or have been mixed with other fuels. Such short-chain alcohol use is as a non-hydrocarbon fuel or as an oxygenate for fuel. More generally, oxygenates include other materials, such as MTBE or methyltetrahydrofuran, see for example developments by Pure Energy Co.

The term "oxygenate" is not always used consistently in the art and sometimes confuses very low molecular weight materials such as short-chain alcohols used for improving fuel combustion, with any other, unspecified oxygen containing molecules, desirable or undesirable, some of which might have quite different technical effect, e.g., lubricating or solvency properties, and which can in principle be present in a fuel.

Some alcohols have been mixed with other alcohols or with hydrocarbons or other non-alcohol oxygenates in applications ranging from perfumes and cleaning or degreasing compositions to enhanced oil recovery. Such latter uses and compositions differ greatly from the uses and compositions of the present invention, first in that a general hydrocarbon such as crude oil are not directly suitable for use as diesel or jet fuel; and second, in that the alcohols are selected for different technical effect and are inferior for the present purposes.

See also: U.S. Pat. Nos. 5,621,155, 5,645,613, 5,324,335, 5,506,272, 5,504,118, 5,500,449, 5,689,031, 5,766,274, 5,814,109, 5,895,506, and WO 98/34999.

Thus, there is continuous innovation and yet there are unmet needs for further improvements. On the other hand, there exists an enormous variety of alcohols, and much experimentation would be required to evaluate them comprehensively for beneficial effect in fuels.

The art on hydrocracking/hydroisomerization is extensive; see for example "Hydrocracking Science and Technology", J. Scherzer and A. J. Gruia, Marcel Dekker, N.Y., 1996, ISBN 0-8247-9760-4, see especially Chapters 10 and 13.

Wax cracking reactions or process steps conducted without added hydrogen are referenced in GB 843,385; U.S. Pat. No. 2,945,076 and U.S. Pat. No. 2,172,228.

In summary, various art-known processes and compositions relating to alcohols in fuels have one or more disadvantages, such as:

- use of linear alcohols with inadequate low-temperature properties;
- limited freedom to blend the alcohols and the balance of the fuel;
- an apparent lack of possibilities to prepare additives having high levels of desirable alcohols of well-defined structure suitable for improving lubricity and which can then be blended into a variety of fuel stocks;

reliance on so-called "native" alcohols, i.e., alcohols that are a byproduct of the Fischer-Tropsch process and that are not available in controlled amounts and with the optimal structures;

lack of possibility to provide concentrates and to ship them or pipeline them as a liquid under ambient or arctic temperatures; and no capability to independently control branching in the alcohol from branching in the hydrocarbon.

SUMMARY OF THE INVENTION

Figure 1A:
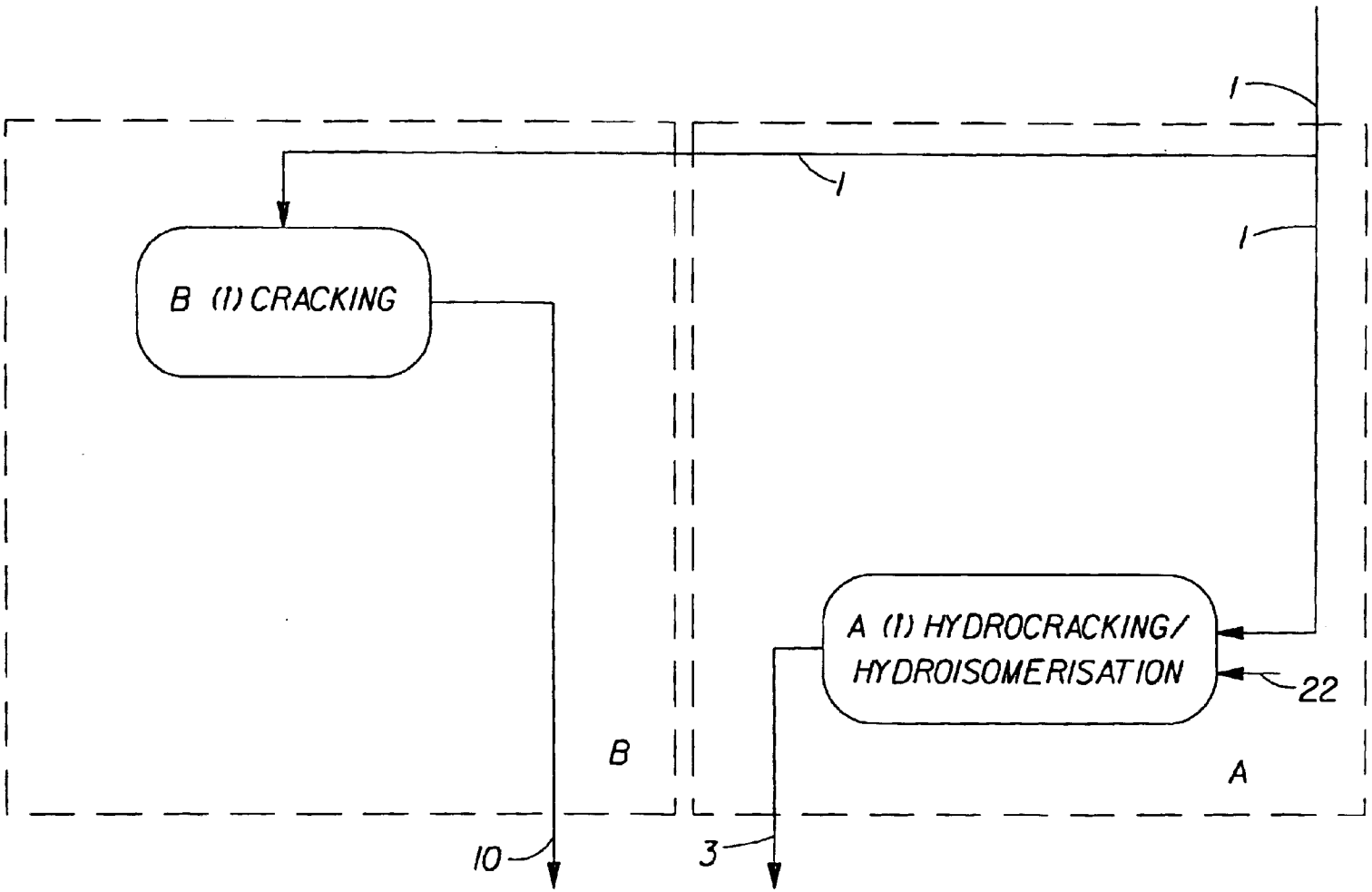
FIG. 1*a* is a flow diagram representing a process embodiment of the present invention having two process batteries preferably for use with petroleum wax.

In its composition embodiments, the present invention encompasses fuel compositions for internal combustion engines such as jet engines, diesel engines, or newly developed engines including new compact diesel types. The fuel compositions have co-optimized combustion and fuel lubricity/transport/storage properties for applications demanding low sulfur content.

In broad terms, the novel fuel compositions comprise at least about 5% of fuel hydrocarbons and at least about 10 ppm of particularly selected nonlinear aliphatic alcohols (NLA), preferably having at least 11 carbon atoms. In all preferred composition embodiments herein, the NLA alcohols as a component of the compositions comprise, and preferably consist essentially of, a mixture of at least two alcohols having different numbers of carbon atoms. In the present processes, especially process streams, NLA in practice is generally further mixed with F.T. Oxo hydrocarbons. In processes or compositions herein, certain diols and other optional adjuncts may also be present. In compositional terms, the preferred NLA alcohols include particularly selected nonlinear primary alcohols, which materials are saturated, acyclic and are mono-alcohols, and which include those nonlinear alcohols (whether Oxo-derived or non-Oxo derived, but preferably Oxo-derived) having the selected structures particularly described hereinafter. Highly preferred nonlinear alcohols (NLA) are certain Oxo type saturated acyclic alcohols which have particular branching as further described in detail hereinafter. In one preferred embodiment, the alcohols are almost completely acyclic, there being from as little as zero % to at most 1% of cyclic alcohols; in this embodiment, the alcohols are generally limited in short chain content and have a number of carbon atoms of from 13 to 21, preferably from 14 to 17.

The fuel compositions of the present invention include compositions of types we term "concentrates", as well as compositions of types we term "blendstocks" and types we term "finished fuels". "Concentrates" or "concentrated additives" herein can include nonlinear Oxo alcohol-rich mixtures with variable levels of Fischer-Tropsch (F.T.) Oxo hydrocarbons, and nonlinear Oxo alcohol-rich mixtures having non-Oxo fuel hydrocarbons beyond the aforementioned hydrocarbon component. A "concentrate" or "concentrated additive" as defined herein is a precursor to a finished fuel composition or blendstock composition, and can be used for a number of purposes. For example, the concentrate can be stored as a liquid, even under extreme low temperatures, and can be pumped or transported to other refineries desiring the lubricity advantages of the nonlinear alcohols in the concentrate, all without the transportation costs of a large amount of hydrocarbon. Optionally with further distillation, the concentrate can serve as an important high concentration source of very desirable alcohols for detergent manufacturers. Moreover, the concentrate can be used in the plant as an alcohol-rich stream for further blending and dilution into lubricious low-sulfur fuels. A concentrate as defined herein is a composition suitable for converting to a fuel blendstock or to a finished fuel composition by blending with additional components.

The fuel compositions herein also include types we term "blendstocks". These differ from "concentrates" in that, in the blendstocks, desired nonlinear alcohols, as are present in the above concentrates, are blended with certain hydrocarbons, thereby achieving full independence in the co-adjusting of fuel lubricity and a second parameter of the fuel selected from fuel smoke point and fuel cetane number. This independence includes both upward and downward adjustability of this second parameter. Preferred "blendstocks" as defined herein comprise at least two fuel hydrocarbon types, specifically including both an F.T. Oxo type and at least one F.T. non-Oxo type, wherein the latter is the majority of the total fuel hydrocarbon.

Blendstocks may be especially useful in that they may use the whole F.T. plant output, into which a significant level of NLA alcohol is blended. Upon shipment to conventional refineries, finished fuel may be made by blending from about 5% to about 25% of this blendstock and the balance conventional refined low-sulfur fuel. Prior to this final blending, the blendstock could be pipelined batchwise, alternating with batches of other petroleum products or crude. For example, Trans Mountain Pipeline Co. Ltd., Vancouver, successfully transports various refined products and crude in batches by a common pipeline over the Canadian Rockies, at least 1100 kilometers from Edmonton to Vancouver. See Oil & Gas Journal, Vol. 96, No. 40, Oct. 5, 1998, pp.49–55.

The fuel compositions herein also include types we term "finished fuels". These differ from "concentrates" and "blendstocks" in that they comprise only low, lubricating levels of NLA, e.g., from about 10 ppm to about 1% whereas the levels of NLA in the blendstocks and concentrates are typically much higher, in general varying widely but remaining consistent with their intended use. For economic reasons, "finished fuels" herein include, when desired, diluting amounts of refined petroleum hydrocarbons. These differ from F.T. hydrocarbons and, particularly, typically include a significant level of cyclic hydrocarbons, though upper limits on desirable levels of certain cyclics are prescribed hereinafter.

Preferred NLA herein include nonlinear primary saturated aliphatic acyclic Oxo monoalcohols, at least 60% of these alcohols comprising at least one $C_1$–$C_3$ alkyl branch on a third or higher carbon atom counting from an Oxo alcohol hydroxy group (—OH). Highly preferred NLA include those of the formula:

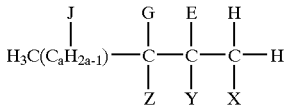

wherein one of X and Y and Z is $CH_2OH$; preferably one of X and Y is $CH_2OH$; more preferably X is $CH_2OH$; any of X and Y and Z which is not $CH_2OH$ is H; E, G and J are selected from H and methyl provided that at least one of E, G and J is methyl, more preferably at least one of G and J is methyl; more preferably still J is methyl and E and G are H; the moiety $C_aH_{2a-1}$ is a linear saturated hydrocarbyl; and a is an integer selected such that the total carbon content of said NLA is from about 11 to about 21. Note that the preferred of the above-identified structures do not allow alcohol comprising any quaternized carbon atoms and are highly biodegradable.

In its process embodiments, the present invention modifies the hitherto disclosed processes for making jet and/or diesel fuel blendstocks to provide piggyback capability for making NLA as jet and/or diesel fuel concentrates and/or blendstocks and/or finished fuels.

In one embodiment, the present process uses a piggyback configuration of wax cracking without hydrogen of a side-stream from a Fischer-Tropsch (F.T.) wax, while conducting conventional hydrocracking/hydroisomerisation (i.e., with hydrogen) of the main stream. The side-stream processing reduces molecular weight, builds suitable branching, and adds monounsaturation so that suitable NLA can then be formed by Oxo reaction and can be used with great flexibility in the production of fuels, as well as to make streams useful for the detergent industry.

In another process variation not shown in the Figures, a suitable distillation cut from a hydrocracked, hydroisomerized paraffin, e.g., from early or midway in the mainstream F.T. processing, is used as a side-stream. This is dehydrogenated, e.g., using a PACOL® process stage. The resulting olefins are used in an Oxo process that directs hydroformylation to terminal or near-terminal positions. Such hydroformylation, involving directing to terminal or near-terminal positions, wherever referred to in the specification, can conveniently be accomplished using the methods disclosed in U.S. Pat. Nos. 3,239,569; 3,239,570; or 3,239,571, incorporated herein by reference, though alternatives having equivalent effect may equally be used.

In yet another process variation, a suitable hydrocarbon fraction for making NLA is obtained by a combination of distillation and hydroisomerization in any order from a F.T. wax without first cracking/hydrocracking. This is dehydrogenated, e.g., using a PACOL® process stage. The resulting olefins are used in an Oxo process that directs hydroformylation to terminal or near-terminal positions, as referenced supra.

In its composition embodiments, the invention further includes clean synthetic jet fuels, clean synthetic diesel fuels, and/or blendstocks therefor made by the process.

All percentages and proportions herein are by weight unless otherwise indicated; all referenced documents, including transcripts of testimony to Congress, are incorporated herein in their entirety. The abbreviation "ppm" refers to parts by million by weight. A suitable conversion is: 0.01%=100 ppm. The abbreviation "F.T." stands for "Fischer-Tropsch". The acronym "NLA" stands for "nonlinear alcohol", a particular selected type of alcohol which is an essential component of compositions of the invention. A preferred type of NLA is a "nonlinear primary aliphatic Oxo alcohol" having specific types of branching as further described hereinafter. The abbreviation "deg." or the term "degrees" unless otherwise noted refers to degrees as used in measurement of temperature. Temperatures can be measured on the Centigrade scale, and are then referred to as "deg. C."; or can be measured on the Farenheit scale, and are then referred to as "deg. F.". When a scale is not specifically identified, the temperature should be understood as a Farenheit scale temperature. When a sign (+ or −) is not specifically indicated, the temperature should be taken as positive, i.e., higher than the zero point of the scale. A sign (−) indicates a temperature below the zero point of the scale. Temperatures may be relative, for example a pour point may be identified as being a certain number of degrees below a specified temperature. In this case, the temperature is obtained by subtracting the modulus of that number of degrees from the reference temperature. Suitable temperature conversion factors are: deg. C.=(deg. F. −32)*5/9 and deg. F.=(9/5*deg. C.)+32.

DETAILED DESCRIPTION OF THE INVENTION

Nonlinear Long Chain Saturated Primary Aliphatic Oxo Alcohol

An essential component of the present compositions and product of the processes of the invention is a selected nonlinear alcohol (NLA). This alcohol is typically a mixture of compounds having a particularly selected structure as described further hereinafter. The NLA itself is further to be distinguished from process streams containing it, for example stream 13 in FIGS. 2, and 3, stream 14 in FIG. 4, stream 13 in FIGS. 5 and 6. These streams are a mixture of the NLA and F.T. Oxo hydrocarbons, the latter overwhelmingly (i.e., essentially all, not counting any impurities) being in paraffinic (i.e., fully hydrogenated) form.

In more detail, the non-hydroxy moieties of the NLA alcohol, commonly referred to as the hydrocarbyl moieties, have a specific type of permissible branching conveyed herein by the term "nonlinear". Preferred NLA herein are saturated and substantially acyclic, (typically no more than about 1%, preferably <0.01% cyclic aliphatic alcohols as impurity). The term "nonlinear" excludes "exclusively linear" and "substantially linear" and is moreover intended to be construed strictly (see for example the structural formulas hereinafter) with respect to the type of departure from linearity. Thus current commercial EXXAL® alcohols, comprising appreciable quaternary carbon content, are, for example, unsuitable as NLA herein. Many other familiar alcohols, including varied branched types, such as Guerbet types, as well as known linear tapes, e.g., Ziegler or the substantially linear NEODOL® alcohols, are unsuitable as NLA.

NLA herein generally comprise at least about 0.3 weight fraction, preferably at least about 0.6 weight fraction, more preferably at least about 0.8 to 1.0 weight fraction of the essential nonlinear long chain saturated primary aliphatic alcohols. The balance of the NLA component can be any other alcohols, for example linear alcohols, and especially those alcohols consistent with the manner in which the NLA is made. NLA can therefore include linear Oxo alcohols, dihydric alcohols, polyhydric alcohols, unsaturated alcohols, cyclic alcohols, etc. in varying proportions, always provided that the necessary minimum amount of specific nonlinear alcohol is present.

In preferred compositions herein, NLA alcohols are specific nonlinear Oxo alcohols, at least 60% of said Oxo alcohols comprising at least one $C_1$–$C_3$ alkyl branch on a third or higher carbon atom counting from an Oxo alcohol hydroxy group.

In one important group of preferred compositions herein, NLA alcohols are monohydric.

However, in another group of preferred compositions, NLA alcohols comprise nonlinear diols or monohydric alcohol/dihydric alcohol mixtures. These nonlinear diols, further illustrated hereinafter, have a dihydric component having structures that have certain features in common with with the monohydric type. However, compositions encompassed herein also include those wherein said nonlinear primary aliphatic Oxo alcohols (NLA) are substantially free from diols.

In functional terms, NLA herein represent alcohols which are selected for biodegradability and at the same time lubricating, pour-point depressing properties as further defined hereinafter. Thus the biodegradability is close or equal to the biodegradability of linear or substantially linear long-chain alcohols, and the lubricating, pour-point depressing properties are at the same time greatly superior.

The present invention includes fuel compositions wherein said nonlinear primary aliphatic Oxo alcohols are selected from lubricating, pour-point depressing nonlinear primary aliphatic Oxo alcohols (NLA). By "lubricating" is meant that the NLA is capable of delivering lubrication as measured, for example, by the BOCLE or HFRR tests, when incorporated into a jet or diesel fuel, to at least the same degree on a mass basis as a linear alcohol of the general type disclosed in U.S. Pat. No. 5,766,274 (jet) or U.S. Pat. No. 5,814,109 (diesel). By "pour point depressing" is qualitatively meant that the NLA has a pour point at least about 10 deg. C. below the pour point of a linear primary alcohol having about the same carbon number. The present invention therefore also includes fuel compositions wherein said nonlinear primary aliphatic Oxo alcohols are present in component (b) (the essential alcohol component) in a weight fraction sufficient to depress the additive pour point, $APP_l$, of component (b) to at least 10 deg. C., preferably at least 50 deg. C., below the additive pour point $APP_R$, of a reference alcohol composition consisting essentially of the corresponding linear primary aliphatic alcohols. For example, a reference alcohol consisting essentially of 1-octadecanol melts (or has an additive pour point $APP_R$,) of about +60 deg. C. In contrast, a sample of $C_{18}$ NLA has a additive pour point ($APP_l$) of below −30 deg. C. Thus, with reference to the above definition, this NLA when used in the invention in place of 1-octadecanol will produce a depression of at least about 90 deg. C., a dramatically superior result. In practice, mixtures of two or more NLA alcohols are more typically used herein, with even better results.

In addition to some limited proportion of unsaturated alcohols, cyclic alcohols etc. in commercial grade NLA, the present compositions may further comprise conventional linear Oxo alcohols, but not as the sole essential alcohol component. Such compositions include the product of blending base stock fuel and members of NLA synthesized nonintegrally with components of said base stock fuel, thereby achieving higher ratios of NLA to linear Oxo alcohols, e.g., at least 10:1, than can be attained by known Fischer-Tropsch wax processes for making oxygenated fuels.

In more highly preferred compositions herein, the NLA alcohols are substantially free from methyl butanols, ethylhexanols, propylheptanols, natural alcohol mixtures, aminoalcohols, aromatic alcohols, glycols having linear hydrocarbon chains, alcohols comprising the aldol condensation product of aldehydes, and alcohols comprising quaternized carbon and consisting of the Oxo product of acid-catalyzed propylene/butylene oligomerization.

NLA Structures

The invention also encompasses fuel compositions wherein the NLA, more particularly nonlinear primary aliphatic alcohols, especially Oxo alcohols, have the formula:

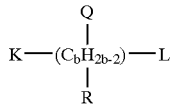

wherein $C_bH_{2b-2}$ is a linear saturated hydrocarbyl and K, L, Q and R are substituents; (K and L preferably being terminally located on said linear saturated hydrocarbyl); K is $CH_3$, L is the moiety:

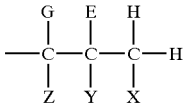

wherein one of X and Y and Z is $CH_2OH$; preferably one of X and Y is $CH_2OH$; more preferably X is $CH_2OH$; and any of X and Y and Z which is not $CH_2OH$ is H; b is an integer selected such that the total carbon content (range in number of carbon atoms) of said nonlinear primary aliphatic Oxo alcohol is from about 11 to about 21 carbon atoms; E, G and Q are selected from H, methyl, ethyl, propyl and butyl provided that at least one of E, G and Q is not H, more preferably at least one of G and Q is not H; more preferably still Q is methyl and E and G are H; and R is selected from H, methyl, ethyl, propyl and butyl; preferably R is H. In preferred NLA of the above formula, when Q and R are both different from H, Q and R are attached to different carbon atoms of said linear saturated hydrocarbyl. Preferably, no carbons are quaternary, i.e., for example, E and Y are not simultaneously carbon-containing. In preferred examples of such NLA, Q and R are both different from H, and Q and R are attached to different carbon atoms of said linear saturated hydrocarbyl.

Note that in the structural formulae throughout the specification, —H is always hydrogen.

Also encompassed herein are fuel compositions wherein said nonlinear primary aliphatic Oxo alcohols (NLA) have the formula:

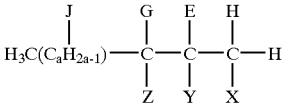

wherein one of X and Y and Z is $CH_2OH$; preferably one of X and Y is $CH_2OH$; more preferably X is $CH_2OH$; any of X and Y and Z which is not $CH_2OH$ is H; E, G and J are selected from H and methyl provided that at least one of E, G and J is methyl, more preferably at least one of G and J is methyl; more preferably still J is methyl and E and G are H; the moiety $C_aH_{2a-1}$ is a linear saturated hydrocarbyl; preferably no carbon atoms are quaternary, i.e., for example, the pair of substituents E and Y are not simultaneously carbon-containing and the pair of substituents G and Z are not simultaneously carbon-containing; and a is an integer selected such that the total carbon content of said nonlinear primary aliphatic Oxo alcohol is from about 11 to about 21.

NLA herein is further nonlimitingly illustrated by:

(I) NLA disclosed in commonly assigned patent publications WO 97/38956, WO 97/38957, WO 9738972, WO 97/39087, WO 97/39088, WO 97/39089, WO 97/39090, WO 97/39091, especially those long-chain alcohols identified therein as mid-chain branched or lightly branched alcohols;

(II) NLA disclosed in WO 98/23566 and U.S. Pat. No. 5,849,960 assigned to Shell. As characterized spectroscopically, these particular alcohols assertedly have both methyl and ethyl branches;

(III) NLA disclosed in U.S. Pat. No. 5,780,694 assigned to Shell. These alcohols are obtained by dimerizing an olefin feed comprising $C_6$–$C_{10}$ linear olefins to obtain certain $C_{12}$–$C_{20}$ olefins which are converted to specific Oxo alcohols by hydroformylation;

(IV) NLA disclosed in AU 8939394 A assigned to Shell. These alcohols are obtained from certain hydroformylated, ethylated olefins;

(V) NLA disclosed in WO 97/01521, Sasol which discloses a process for producing Fischer-Tropsch alcohols from Sasol's Fischer-Tropsch, e.g., Synthol, olefin/paraffin mixtures. These can be of widely varying chainlength, and include some nonlinear long chain saturated primary aliphatic alcohols that are suitably long-chained;

(VI) NLA disclosed in US H 0001818, Sasol which discloses detergent alcohols made from their olefins, and use thereof for making detergents. The alcohols include some nonlinear saturated primary aliphatic alcohols ($C_9$–$C_{15}$) that include long-chain (e.g, $C_{11}$ or higher) nonlinear saturated primary aliphatic alcohols. The alcohols comprise mixtures of linear and methyl branched species;

(VII) much less desirably, NLA known as LIAL® alcohols available from Enichem. LIAL® alcohols are referred to elsewhere herein as "alcohols comprising the Oxo product of linear internal olefins".

Note that in general the above-referenced materials can be interchanged for purposes of the present fuel compositions which comprise fuel hydrocarbons. Otherwise, they are all separately and distinctly recognized materials in the art and are not interchangeable in general, for example in detergents.

Preferred NLA in (I)–(VII) include NLA's (I), (II), (V), (VI), and any mixtures thereof.

Particularly preferred NLA in (I)–(VII) include NLA's (I), (II), and mixtures thereof in all or any proportions.

Essential Fuel Hydrocarbon

The essential fuel hydrocarbon herein in general requires at least one fuel hydrocarbon selected such that, in combination with the above-identified nonlinear primary aliphatic alcohol, a fuel results which will burn cleanly and will be lubricious. In general, the fuel hydrocarbon can vary quite broadly. However, in all the preferred compositions, at least one fuel hydrocarbon is present which is defined as an F.T. Oxo hydrocarbon, that is a fuel hydrocarbon derived from passage through both stages of a process having both a Fischer-Tropsch stage and at least one Oxo reaction stage (the latter primarily directed for making alcohol).

The preferred compositions herein comprise fuel hydrocarbons in one of the following variations:

both an F.T. Oxo hydrocarbon and at least one F.T. non Oxo hydrocarbon;

both an F.T. Oxo hydrocarbon and at least one non-F.T, non-Oxo hydrocarbon; and all three of an F.T. Oxo hydrocarbon, an F.T. non-Oxo hydrocarbon, and a non-F.T., non Oxo hydrocarbon.

In general any of the above hydrocarbons can vary in degree of hydrogenation and olefinic, paraffinic and olefinic/paraffinic variants are encompassed especially in terms of process streams. However, preferably in the composition embodiments and in preferred output streams of the processes herein, the F.T. Oxo hydrocarbons and F.T. non-Oxo hydrocarbons are substantially fully hydrogenated, i.e., other than impurities which are counted separately in the compositions, these fuel hydrocarbons are paraffins. The non-F.T., non-Oxo hydrocarbon can vary more widely in both the composition and process embodiments, but embodiments are included in which this hydrocarbon, as in the case of the other types, is essentially paraffins.

In more detail, the differences between the different types of fuel hydrocarbons in the present compositions can be exemplified or illustrated as in the following Tables. We introduce first a "reference hydrocarbon" since such a hydrocarbon is one which is relatable to the above-identified and fully disclosed nonlinear alcohol (NLA) simply in that it is its hydrogenolysis product. See for example R. G. Brownlee and R. M. Silverstein, Anal. Chem., Vol. 40 (13), pp. 2077–9, (1968) or M. Beroza and R. Sarmiento, Anal. Chem., Vol. 37, p. 1042 (1965) for suitable microhydrogenolysis methods. Then the other types of fuel hydrocarbon are readily compared to the reference hydrocarbon. Note also that NLA's herein can be separated from fuel hydrocarbons by any known techniques, for example silica gel adsorption chromatography (HPLC).

TABLE 1

| | RH |
|---|---|
| Hydrocarbon | Reference Hydrocarbon (analytical standard) hydrocarbon corresponding exactly to the nonlinear alcohol (NLA) minus OH group(s) |
| Process/Source: | derivable from NLA by specified procedure, microhydrogenolysis (see the text). |
| linearity or branching | type and degree of branching identical to NLA; no quaternary carbons |
| carbon range and distribution | narrow carbon distribution per G.C; two-carbon or four-carbon range, preferably including at least one carbon number in range 14–17; preferably range never goes down to 11 |
| cyclics (cycloaliphatic) | <5%, often <1% |
| aromatics | <=1% |

TABLE 2

| | fuel hydrocarbon (a)(i) |
|---|---|
| Hydrocarbon: | F.T. Oxo hydrocarbon |
| Process/Source: | derived by F.T. and formed and/or passed through an Oxo reactor |
| linearity or branching | less branching than NLA; no quaternary carbons |
| carbon range and distribution | narrow carbon distribution per G.C; two-carbon or four-carbon range, preferably including at least one carbon number in range 13–16; preferably range never goes down to 10. |
| Cyclics (cycloaliphatic) | <5%, often <1% |
| aromatics | <=1% |

TABLE 3

| | fuel hydrocarbon (a)(ii) |
|---|---|
| Hydrocarbon: | F.T. non-Oxo hydrocarbon |
| Process/Source: | derived by F.T. and not formed in or passed through an Oxo reactor |
| linearity or branching | less branching than RH and NLA; no quaternary carbons |
| carbon range and distribution | broader carbon distribution per G.C than RH; distribution typical of current commercial jet and/or diesel fuel hydrocarbons |
| cyclics (cycloaliphatic) | <5%, often <1% |
| aromatics | <=1% |

TABLE 4

| | fuel hydrocarbon (a)(iii) |
|---|---|
| Hydrocarbon: | Fuel hydrocarbon other than (a)(i) or (a)(ii) |
| Process/Source: | derived from refining of petroleum; not derived by F.T. and not formed in or passed through an Oxo reactor |
| linearity or branching | more branching than RH; often includes quaternary carbons |
| carbon range and distribution | broader carbon distribution per G.C than RH; distribution typical of current commercial jet and/or diesel fuel hydrocarbons |
| cyclics (cycloaliphatic) | >=10% |
| aromatics | usually >5% |

For compositions of the invention to be used as diesel fuel, the fuel hydrocarbon component herein can, for example, be generally one meeting the specification illustrated in "Swedish city diesel class one", see "The Chemical Engineer", Issue 632, April 1997, pages 28–32; or as exemplified in U.S. Pat. No. 5,689,031, see Col. 4, but differing in the presence of both F.T. Oxo and F.T. non Oxo hydrocarbons.

For compositions of the invention to be used as jet fuel, the fuel hydrocarbon component herein can, for example, be generally one meeting the specification illustrated in U.S. Pat. No. 5,766,274, see Col. 2, but differing in the presence of both F.T. Oxo and F.T. non-Oxo hydrocarbons.

In practice the fuel hydrocarbon herein must not only meet specifications such as those referenced above, but also must have particular compositions as described in greater detail, for example in the section identified as "Compositions" hereinafter.

The terms "cut", "two-carbon cut" and "four carbon cut" may be used herein in referring to fuel hydrocarbons, Oxo alcohols or process streams. A "cut" is a practically obtainable distillation fraction of fuel hydrocarbons or of alcohols. For example an "olefin/paraffin" cut is a mixture of olefins and paraffins obtainable as a mixture when distilling in a particular temperature range. A "jet/diesel cut" is a mixture of fuel hydrocarbons having boiling temperatures in a range consistent with jet and diesel fuels. A "two carbon cut" (e.g., a $C_{14}$–$C_{15}$ cut) is a distillation fraction containing all the compounds having a first specified total number of carbon atoms (e.g., 14) and all the compounds having a second specified total number of carbon atoms (e.g., 15). A "four carbon cut", e.g., a $C_{14}$–$C_{17}$ cut, is a distillation fraction having a first specified total number of carbon atoms (e.g., 14) and all the compounds in the range (e.g., at $C_{15}$ or $C_{16}$ or $C_{17}$) up to a second specified (e.g., 17) total number of carbon atoms. Very usefully, it is observed that a two-carbon cut of NLA alcohols in a preferred range of carbon number can be separated by distillation, e.g., stream 14 in FIG. 3, unit B(v), from other components, e.g., diols, stream 19 and hydrocarbons, stream 15.

Diols

The present invention can also make use of certain diols, specifically diols which possess certain commonalities in structure with the above-identified NLA. Diols herein are not however counted as part of the essential NLA component. Thus also encompassed herein are fuel compositions comprising nonlinear diols of the formula:

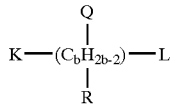

wherein $C_bH_{2b-2}$ is a linear saturated hydrocarbyl and K, L, Q and R are substituents; K and L are independently selected from:

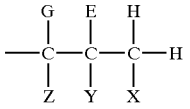

wherein one of X and Y and Z is $CH_2OH$; preferably one of X and Y is $CH_2OH$; more preferably X is $CH_2OH$; and any of X and Y and Z which is not $CH_2OH$ is H; b is an integer selected such that the total carbon content of said nonlinear diol is from about 12 to about 22; E, G and Q are selected from H, methyl, ethyl, propyl and butyl provided that at least one of E; G and Q is not H, more preferably at least one of G and Q is not H; more preferably still Q is methyl and E and G are H; and R is selected from H, methyl, ethyl, propyl and butyl, preferably R is H. In preferred fuel compositions comprising nonlinear diols, said nonlinear diols are nonlinear Oxo diols, and wherein when Q and R are both different from H, Q and R are attached to different carbon atoms of said linear saturated hydrocarbyl. When nonlinear diols are present in the compositions of the invention, the nonlinear primary aliphatic Oxo alcohols, (b), which are also present in all the preferred embodiments, and said nonlinear diols, (d), are present in the compositions at a ratio (b): (d), of from about 1000:1 to about 2:1 by weight. Nonlinear diols when present in the compositions of the invention are generally at a level of from about 0.001 ppm to about 30% by weight of the fuel composition. To the extent that the above-identified nonlinear diols are novel, the invention also encompasses the above-identified nonlinear diols per-se.

Non-Essential Alcohols

In general, alcohols other than the above-identified nonlinear alcohols, for example any other primary or secondary $C_{10}$–$C_{20}$ alcohols or primary/secondary diols, can be added to the present fuel compositions, for example for purposes other than lubricity, however such addition is avoided in all the preferred embodiments. Examples of other alcohols include especially Linear Alcohols:

Long-chain primary alcohols that are linear are disclosed in U.S. Pat. Nos. 5,689,031, 5,766,274, 5,814,109 and WO 98/34999 all assigned to Exxon.

Highly Branched Alcohols:

Exxon further has disclosed in commerce certain long-chain alcohols that are highly branched; these are available as EXXAL® alcohols, derived from propylene and/or butylene oligomerization through acid catalysis to a range of monoolefins, the range having an average of $C_{13}$ but containing some $C_{10}$–$C_{15}$ other than $C_{13}$, and subsequent hydroformylation using an Oxo process. EXXAL® 13 for example has been reported to be a 3–4 methyl branched tridecyl alcohol known for its use in lubricants and in detergents of types not requiring rapid biodegradation. EXXAL alcohols are referred to elsewhere herein as "alcohols comprising quaternized carbon and consisting of the Oxo product of acid-catalyzed propylene/butylene oligomerization". While the present invention avoids such alcohols in the preferred embodiments, their at least partial use in conjunction with the NLA component as defined herein might be contemplated, for example, by practitioners not requiring the maximum levels of biodegradation made possible when only NLA alcohol is used.

Other Alcohols

Also known in the art are alcohols such as amyl alcohol, which are related to certain cetane enhancers, and other alcohols, such as 2-ethylhexanol, comprising the aldol condensation product of certain aldehydes. These aldehydes are formed by Oxo reaction of low molecular weight olefins. In more detail, these aldehydes are aldol-condensed, dehydrated, and hydrogenated. Similarly alcohols can be dimerized under dehydrogenation/hydrogenation conditions in the presence of an aldol condensation catalyst; these are known as Guerbet alcohols, and are commercially available, for example as ISOFOL® alcohols from Condea.

A wide variety of Ziegler alcohols are known in the art; these are essentially linear and lie outside of the definition of nonlinear primary Oxo alcohols (NLA) herein.

In the manufacture of the NEODOL® alcohols, as is known in the art, see for example the background of U.S. Pat. No. 5,780,694, a predominantly linear olefin feed is subjected to hydroformylation by reacting carbon monoxide and hydrogen onto the olefin in presence of a specific Oxo catalyst; and generally, 80% or more of the number of alcohol molecules in the resultant alcohol composition are linear primary alcohols. It is further stated that of the branched primary alcohols in the composition, substantially all, if not all, of the branching is on the $C_2$ carbon atom relative to the hydroxyl bearing carbon atom. For the purposes of the present invention, current commercial NEODOL® alcohols lie outside of the definition of nonlinear primary Oxo alcohols as used herein in defining an essential component of the invention. This exclusion is based on the combination of NEODOL's® 80%+ linear content and the branching position which is almost exclusively located on the $C_2$ carbon atom.

Levels of Alcohols Other Than NLA

Suitable levels of alcohols other than NLA are further illustrated by the following: compositions further comprising: (c) from about 0.001 ppm to about 30% of linear $C_{11}$ to $C_{21}$ alcohols; compositions further comprising: (d) from about 0.001 ppm to about 30% of $C_{12}$ to $C_{22}$ nonlinear primary aliphatic diols; and compositions further comprising: (e) from about 0.0001 ppm to about 3% of $C_{12}$ to $C_{22}$ linear primary aliphatic diols.

The invention also encompasses compositions further comprising: (f) from about 0.001 ppm to about 30% of a mixture of members selected from: linear $C_{11}$ to $C_{21}$ alcohols; $C_{12}$ to $C_{22}$ nonlinear primary aliphatic diols; and $C_{12}$ to $C_{22}$ linear primary aliphatic diols.

Compositions

In more detail, the present invention encompasses fuel compositions comprising NLA and certain fuel hydrocarbons. The compositions include those consisting essentially of these components. Encompassed compositions include those wherein said fuel hydrocarbons comprise at least two distinct types of fuel hydrocarbons and wherein at least 0.6 weight fraction (to 1.0 weight fraction) of said nonlinear primary aliphatic alcohols are nonlinear primary aliphatic Oxo alcohols comprising at least one $C_1$–$C_3$ alkyl substituent situated on a third or higher carbon atom counting from an Oxo alcohol hydroxy group; and not more than about 0.02 weight fraction, preferably not more than about 0.001 weight fraction of said nonlinear primary aliphatic Oxo alcohols comprises a quaternary substituted carbon atom.

In preferred compositions of this type, said at least two types of fuel hydrocarbons are differentiated in that a first type of fuel hydrocarbon is present which is selected from Fischer-Tropsch Oxo hydrocarbons and in that a second type of fuel hydrocarbon is present which is other than said first type of fuel hydrocarbon.

The present invention also includes fuel compositions comprising: from about 5% to about 99.9990%, preferably from 10% to about 99.990%, of said fuel hydrocarbons and from about 10 ppm to about 95%, preferably from 100 ppm to about 90%, of said nonlinear primary aliphatic Oxo alcohol; wherein said fuel hydrocarbons comprise Fischer-Tropsch Oxo hydrocarbons; and said nonlinear primary aliphatic Oxo alcohols have an average of from about 11 to about 21 carbon atoms; said composition further comprising a member selected from the group consisting of: (c) linear long-chain ($C_{11}$–$C_{21}$) monoalcohols, preferably linear long-chain ($C_{11}$–$C_{21}$) Oxo monoalcohols; (d) nonlinear ($C_{12}$–$C_{22}$) diols, preferably nonlinear ($C_{12}$–$C_{22}$) Oxo diols; (e) linear ($C_{12}$–$C_{22}$) diols, preferably linear ($C_{12}$–$C_{22}$) Oxo diols, and mixtures of two or more of (c)–(e).

Also included herein is a composition wherein said components (b) (i.e., NLA) and (c) (i.e., linear long-chain alcohols) are present at a (b): (c) ratio of at least about 2:1, preferably 10:1, more preferably at least 100:1 by weight. When diols are present, typically the weight ratio (b): (d) is about 2:1, more preferably 10:1. The ratio (d): (e) is typically about 10:1, preferably higher. Preferably the content of linear alcohols, i.e., (c); (c) or (e) or the sum of (c)+(e), is selected such that it approaches zero as the carbon number increases above 12.

Important embodiments of the present invention include those wherein there is little or no diol present, especially when diol is linear. There is a preference to select nonlinear diols and to avoid linear ones.

Concentrates (e.g., NLA and F.T. Oxo Hydrocarbon)

Also included are compositions comprising from about 20% to about 95%, typically from 30% to about 60%, of said nonlinear primary aliphatic Oxo alcohol; and wherein said fuel hydrocarbons, (a), comprise: from about 5% to about 80%, typically from 40% to about 70%, of a first type of fuel hydrocarbons selected from Fischer-Tropsch Oxo hydrocarbons; and wherein at least 0.8 weight fraction (up to 1.0 weight fraction) of said nonlinear primary aliphatic Oxo alcohols comprises at least one $C_1$–$C_3$ alkyl substituent situated on a third or higher carbon atom counting from an Oxo alcohol hydroxy group; and none of, or not more than about 0.01 weight fraction of, said nonlinear primary aliphatic Oxo alcohols comprises a quaternary substituted carbon atom.

Blendstocks Comprising NLA, F.T. Oxo Hydrocarbons and F.T. Non-Oxo Hydrocarbons

The inventive compositions include those having the form of blendstocks having both F.T. Oxo hydrocarbons and F.T. non-Oxo hydrocarbons. These are illustrated by fuel compositions comprising from about 0.1% to about 19% of said nonlinear primary aliphatic Oxo alcohol; and wherein said fuel hydrocarbons, (a), comprise: (i) from about 0.05% to about 18% of a first type of fuel hydrocarbons selected from Fischer-Tropsch Oxo hydrocarbons and (ii) from about 80% to about 99% of a second type of fuel hydrocarbons selected from Fischer-Tropsch non-Oxo hydrocarbons; and wherein at least 0.8 weight fraction (to 1.0 weight fraction) of said nonlinear primary aliphatic Oxo alcohols comprises at least one $C_1$–$C_3$ alkyl substituent situated on a third or higher carbon atom counting from an Oxo alcohol hydroxy group; and not more than about 0.001 weight fraction of said nonlinear primary aliphatic Oxo alcohols comprises a quaternary substituted carbon atom.

When two types of fuel hydrocarbons are present e.g., F.T. Oxo hydrocarbons and F.T. non-Oxo hydrocarbons, compositions may suitably have a ratio of said second type of fuel hydrocarbons to said first type of fuel hydrocarbons of at least about 10:1 (to e.g., 100:1 or higher) by weight.

The inventive compositions also include those having the form of a "concentrate" as defined hereinabove, for example a concentrated fuel additive comprising from about 0.2% to about 19% of said nonlinear primary aliphatic Oxo alcohol and from about 81% to about 99.8% of said fuel hydrocarbons; and wherein said nonlinear primary aliphatic Oxo alcohols have an independently variable degree of branching, $DOB_a$, which exceeds the degree of branching of said fuel hydrocarbons, $DOB_F$, according to the relation: $DOB_a=DOB_F+0.3$. In especially important embodiments of this type, the fuel hydrocarbons consist essentially of a mixture of F.T. Oxo hydrocarbons and F.T. non-Oxo hydrocarbons, with the latter being the predominant component. DOB or degree of branching is the number of branches in a molecule. Pragmatically for example, when dealing with a mixture of branched fuel hydrocarbon compounds, $DOB_F$ is the $^1H$ nmr integral of methyl moieties minus two. When dealing with a NLA alcohol mixture, $DOB_a$ is the integral of methyl moieties minus one.

Other fuel compositions herein can have the form of blendstocks or finished fuels and comprise from about 0.01% to about 10%, preferably no more than about 1%, of said nonlinear primary aliphatic Oxo alcohol; and wherein said fuel hydrocarbons, (a), comprise: (i) from about 0.005% to about 12% of a first type of fuel hydrocarbons selected from Fischer-Tropsch Oxo hydrocarbons; (ii) from 0% to about 99.8% of a second type of fuel hydrocarbons selected from Fischer-Tropsch non-Oxo hydrocarbons; and (iii) from about 0.1%, preferably at least 5%, to about 99.995% of at least one other type of fuel hydrocarbons selected from fuel hydrocarbons other than (i) and (ii); and wherein at least 0.6 weight fraction (preferably from 0.8 to 1.0 weight fraction) of said nonlinear primary aliphatic Oxo alcohols, (b), comprises at least one $C_1$–$C_3$ alkyl substituent situated on a third or higher carbon atom counting from an Oxo alcohol hydroxy group. Such compositions include those wherein said third type of fuel hydrocarbon, (iii) is present at non-zero levels, such compositions comprising, for example, at least 0.1 weight fraction saturated cyclic hydrocarbons; and wherein all other types of fuel hydrocarbons present comprise less than about 0.05 weight fraction of saturated cyclic hydrocarbons. When three types of fuel hydrocarbons are present e.g., (i) F.T. Oxo hydrocarbons, (ii) F.T. non-Oxo hydrocarbons and (iii) a type of fuel hydrocarbon which is other than Fischer-Tropsch-derived, the composition may suitably have a ratio of said other type, (iii), of fuel hydrocarbons to said first type, (i), of fuel hydrocarbons of at least about 10:1 (to e.g., 50,000:1) by weight.

Finished Fuel—Diesel

In the diesel fuel embodiments of the invention, there is included a composition wherein said combustion engine is a diesel engine; and wherein said fuel hydrocarbons comprise from about 10 to about 20 carbon atoms; and said composition has:

- a flow point of −25 deg. C. or below; and optionally but preferably
- a cetane number of at least about 45, preferably about 50 or higher;
- a sulfur content of less than 50 ppm, preferably less than 5 ppm; and
- an aromatics content of less than about 10% by weight, preferably less than 5%, more preferably less than about 1% by weight. Pragmatically, the latter aromatics content is often measured as volume %, and in this case, the differences between weight % and volume % are relatively small.

A preferred composition of the type adapted for use as diesel fuel comprises: (a) at least about 90% of said fuel hydrocarbons; and (b) from about 100 ppm to 5%, preferably about 500 ppm to about 3% of said nonlinear primary aliphatic Oxo alcohols having from 11 to 21 carbon atoms, preferably from 12 to 17 carbon atoms.

Note that in the above diesel fuel embodiments, it will be typical for the fuel hydrocarbon component to have a relatively wider distribution of carbon atom content than is present in the nonlinear alcohol of the same composition.

Finished Fuel—Jet

In the jet fuel embodiments of the invention, there is included a composition wherein said combustion engine is a jet engine; said fuel hydrocarbons comprise from about 9 to about 14 carbon atoms; and said composition has a flow point of −47 deg. C. or below; and a smoke point of at least 18 mm wick, the latter millimeters length of wick measure being well known in the industry. Such a jet fuel has a sulfur content of from zero ppm to less than 50 ppm, preferably less than 5 ppm.

A preferred composition of the type adapted for use as jet fuel comprises: (a) at least about 90% of said fuel hydrocarbons; and (b) from about 100 ppm, preferably about 500 ppm, to about 5% of said nonlinear primary aliphatic Oxo alcohols having from 11 to about 17 carbon atoms, preferably from 12 to 17 carbon atoms. These jet fuel compositions include ones in which the nonlinear primary aliphatic Oxo alcohols contain more carbon atoms than do the fuel hydrocarbons. To illustrate, specifically included are jet fuel compositions wherein the fuel hydrocarbon has from 9 to 14 carbon atoms and the nonlinear primary aliphatic Oxo alcohol has a hydrocarbon chain containing an overall number of carbon atoms in the range 14–17.

Finished Fuel—New Engines

In the fuel for new engine types embodiments of the invention, there is included a composition wherein said combustion engine is a new compact diesel or other non-traditional engine; said fuel hydrocarbons comprise from about 5 carbon atoms to about 14 carbon atoms; and said composition has a flow point of −25 deg. C. or below, preferably −47 deg. C. or below; and preferably, a cetane number of at least about 45, preferably about 50 or higher, more preferably at least about 60 or higher; a sulfur content of less than about 50 ppm, preferably less than about 5 ppm; and an aromatics content of less than about 10 volume %, preferably less than about 1% by weight. Preferred in such compositions are those comprising: (a) at least about 90% to about 99.9% of said fuel hydrocarbons; and (b) from about 100 ppm to about 10% of said nonlinear primary aliphatic Oxo alcohols. The specification for new, non-traditional diesel fuel is, for example, in general accordance with the specification ranges of U.S. Pat. No. 5,807,413.

These fuel compositions for new types of engines include ones in which the nonlinear primary aliphatic Oxo alcohols contain more carbon atoms than do the fuel hydrocarbons. To illustrate, specifically included are fuel compositions wherein the fuel hydrocarbon has from 7 to 12 carbon atoms, or from 9 to 14 carbon atoms, and the nonlinear primary aliphatic Oxo alcohol in the same fuel composition has a hydrocarbon chain containing an overall number of carbon atoms in the range 14–17.

Concentrates

Particularly desirable "concentrates" herein include fuel compositions having the form of a concentrated fuel additive, comprising: from about 5% to about 90% of said fuel hydrocarbons and from about 10% to about 95% of said nonlinear primary aliphatic Oxo alcohol; wherein said fuel hydrocarbons are derived from F.T.wax, petroleum wax and mixtures thereof, preferably wherein said fuel hydrocarbons are derived from F.T. wax, and said fuel hydrocarbons comprise said Fischer-Tropsch—Oxo hydrocarbons; and said nonlinear primary aliphatic Oxo alcohol is in the form of a two-carbon alcohol cut selected from a $C_{12}$–$C_{13}$ cut, a $C_{14}$–$C_{15}$ cut and a $C_{16}$–$C_{17}$ cut.

Other Concentrates

Also particularly desirable "concentrates" herein include fuel compositions having the form of a concentrated fuel additive comprising: from about 5% to about 90% of said fuel hydrocarbons and from about 10% to about 95% of said nonlinear primary aliphatic Oxo alcohol; wherein said fuel hydrocarbons are derived from F.T.wax, petroleum wax and mixtures thereof, preferably wherein said fuel hydrocarbons are derived from F.T. wax and said fuel hydrocarbons comprise said Fischer-Tropsch—Oxo hydrocarbons; and said nonlinear primary aliphatic Oxo alcohol is in the form of a four-carbon alcohol cut selected from a $C_{14}$–$C_{17}$ cut.

Preferred Finished Fuels

Among the finished fuel embodiments, the invention includes a fuel composition for internal combustion engines, said fuel composition having co-optimized combustion and fuel lubricity/transport/storage properties for applications demanding low sulfur content, said fuel composition comprising: (a) at least about 5% of fuel hydrocarbons (in practice, finished fuels more typically comprise 95% or greater by weight of fuel hydrocarbons); the fuel hydrocarbons comprising: (i) from about 1 ppm to about 10% by weight of the overall composition of a first type of fuel hydrocarbons having from about 10 to about 20 carbon atoms selected from Fischer-Tropsch Oxo hydrocarbons; and at least one additional type of fuel hydrocarbons having at least about 5 (preferably to about 20) carbon atoms. This additional type of fuel hydrocarbons is a member selected from: (ii) from 0% to about 99% of a second type of fuel hydrocarbons selected from Fischer-Tropsch non-Oxo hydrocarbons and (iii) from 0% to about 99% of at least one other type of fuel hydrocarbons, other than (a) (i) and (a) (ii); provided that the sum of (a) (ii) and (a) (iii) is at least about 80%. The composition also comprises (b) at least about 10 ppm of nonlinear primary aliphatic Oxo alcohols having at least 11 (preferably to about 21) carbon atoms wherein at least 0.6 weight fraction of said nonlinear primary aliphatic Oxo alcohols comprises at least one $C_1$–$C_3$ alkyl substituent situated on a third or higher carbon atom counting from an Oxo alcohol hydroxy group; and not more than about 0.01 weight fraction, preferably not more than about 0.001 weight fraction of said nonlinear primary aliphatic Oxo alcohols comprises a quaternary substituted carbon atom; and (c) at least about 0.001 ppm of linear primary Oxo alcohols having at least 11 carbon atoms; wherein said fuel has a ratio by weight {(a)(ii)+(a)(iii)}:(a)(i) of at least about 10:1; a ratio by weight (b):(c) of at least about 1:10, preferably at least 1:2, more preferably at least 2:1, more preferably still at least 10:1; and a low level of sulfur, of from zero ppm to no more than about 50 ppm, preferably no more than about 5 ppm. Preferred among such compositions are those having an independence of the average number of carbon atoms of component (b) as compared with {(a)(i)+(a)(ii)+(a) (iii)}; and wherein the composition is produced by a process having at least one step of blending a preformed concentrated fuel additive comprising at least said components (a) (i), (b) and (c) with a portion of said fuel hydrocarbons, said portion being selected from (a)(ii), (a) (iii) and (a)(ii)+(a) (iii). In the above, the independence referred to is due to the fact that whereas the average number of carbon atoms of component (b) and the average number of carbon atoms of component (a)(i) are linked, the sum {(a)(i)+(a)(ii)+(a) (iii)} is dominated by components other than (a)(i), permitting the latter average to vary independently for all practical purposes. Further, preferably, said component, (a)(iii), comprises at least 0.1 weight fraction saturated cyclic hydrocarbons, e.g., cyclohexanes, cyclopentanes or other saturated cyclic hydrocarbons comprising two or more rings selected from six-membered carbon rings and five-membered carbon rings; whereas said components, (a)(i) and (a)(ii), each comprise less than 0.05 weight fraction of saturated cyclic hydrocarbons.

Processes and Products of the Process

The present invention also includes processes for making the compositions, and forms of the compositions derivable by the specific preferred processes. In their simplest form, the processes include one or more blending steps. Thus, in its blendstock or finished fuel embodiments, the present invention encompasses a fuel composition having the form of a fuel blendstock or finished fuel composition prepared by blending any of the above-identified mixtures of NLA and first type of hydrocarbon (F.T. Oxo hydrocarbon) with any fuel hydrocarbon, fuel blend stock or fuel not comprising said first type of fuel hydrocarbon.

Preferred fuel compositions herein also include those wherein said components (a) and (b), (or at least part of (a) and all of (b)) i.e., F.T. Oxo hydrocarbon a(i) and the NLA, are cosynthesized. By "cosynthesized" is meant that the NLA is prepared by at least one step of reacting in an Oxo reactor and that the F.T. Oxo hydrocarbon is also present in that reactor. Note that by our definition, the Oxo hydrocarbon needs to have been present in the alcohol synthesis reactor, however, it need not have been chemically formed or changed in that reactor.

Other preferred compositions herein are the product of blending said fuel hydrocarbons and members of said nonlinear primary aliphatic Oxo alcohols synthesized nonintegrally with components of said fuel hydrocarbons, thereby achieving higher ratios, (b):(c), of said nonlinear primary aliphatic Oxo alcohols to linear Oxo alcohols than can be attained by known Fischer-Tropsch wax processes for making oxygenated fuels. By the term "synthesized nonintegrally" is meant that the nonlinear primary aliphatic Oxo alcohols referred to are not F.T. "native" alcohols (see the discussion of "native" F.T. alcohols elsewhere herein).

In terms of the process by which they can be made, the fuel compositions herein, for example those for use as jet fuel or diesel fuel, include those which can be described as comprising the product of blending: (a) from about 90% to about 99.9% of fuel hydrocarbons having from about 9 carbon atoms to about 20 carbon atoms; and (b) from about 100 ppm to about 10% of nonlinear primary aliphatic Oxo alcohols (NLA), wherein said (NLA) alcohols are the product of a process, preferably nonintegral with the process of forming said component (a), wherein the process comprises: (I) a first stage comprising: providing a member selected from (A) F.T. wax; (B) conventional petroleum wax; (C) a fuel hydrocarbon distillation cut in the jet/diesel range, said distillation cut comprising at least about 0.8 weight fraction to 1.0 weight fraction of linear paraffins, mono-, di- or tri-$C_1$–$C_3$ branched acyclic paraffins, or mixtures thereof, (D) mixtures thereof; (preferably between stage (I) and (II) distilling as needed); (II) a pre-Oxo stage comprising sequentially or concurrently delinearizing and preparing the product of the first stage for Oxo reaction, said stage comprising two or more steps in any order selected from steps capable of effecting (i) chain-breaking, (ii) branch-forming and (iii) olefin-forming; and (III) an Oxo/post-Oxo stage comprising converting the product of the pre-Oxo stage to said alcohol (the NLA), said stage comprising at least one Oxo step and further optionally comprising a step selected from an Oxo aldehyde to alcohol conversion step, a step of hydrogenating residual olefins to paraffins, and combinations thereof. Optionally in stage (III), any residual olefin can be hydrogenated to paraffin. The corresponding process, as distinct from its product, is likewise within the spirit and scope of the present invention.

A simple process embodiment of the present invention has two process batteries. e.g., A and B. Both of these batteries are present in each of FIGS. 1*a* and 1*b*. The input scream, 1, differs in FIG. 1*a* and FIG. 1*b*. In FIG. 1*a*, the input stream is suitably petroleum wax, and in FIG. 1*b*, the input stream is suitably Fischer-Tropsch wax. Such a process stream 1 is preferably derived from modem Fischer-Tropsch slurry-phase technology.

Figure 1B:
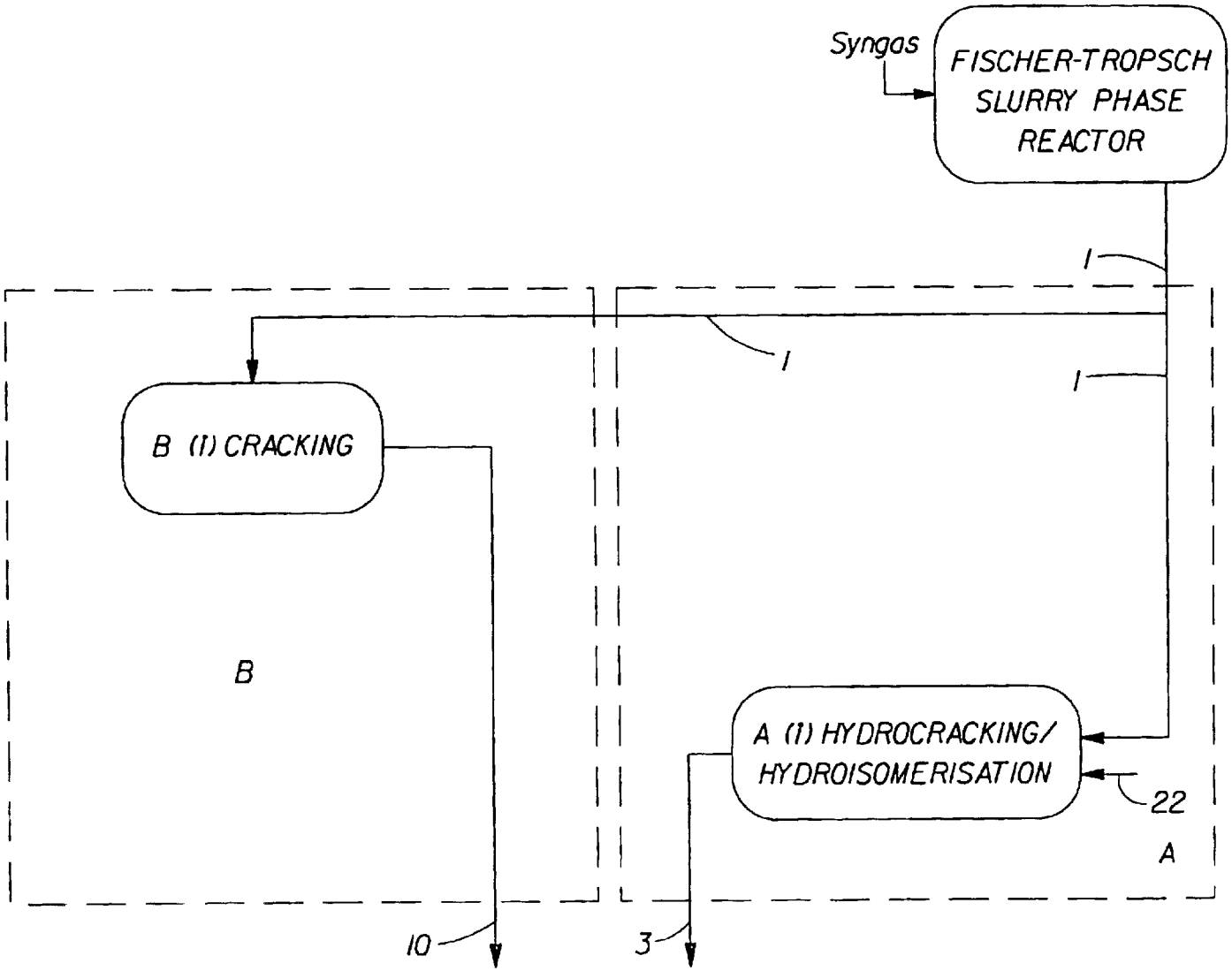
FIG. 1*b* is a flow diagram representing a process embodiment of the present invention having two process batteries preferably for use with FISCHER-TROPSCH wax.

In each of FIGS. 1*a* and 1*b*, the first battery, A, is a large-scale fuel-making battery, which includes the largest streams of the process in terms of volume. In each of FIG. 1*a* and 1*b*, the waxy stream, 1, is split and a portion is sent to battery B where it is cracked to long-chain alpha-olefins and paraffins in one or more steps shown as B(i), substantially in the absence of added hydrogen, unlike the main portion of stream 1 which is hydrocracked/hydroisomerized in one or more steps shown as A(i) in the presence of added hydrogen, (stream 22). Note that B(i) uses old detergent technology (which is not at all conventional at such long chain-lengths in modem fuel-making plants).

Figure 2:
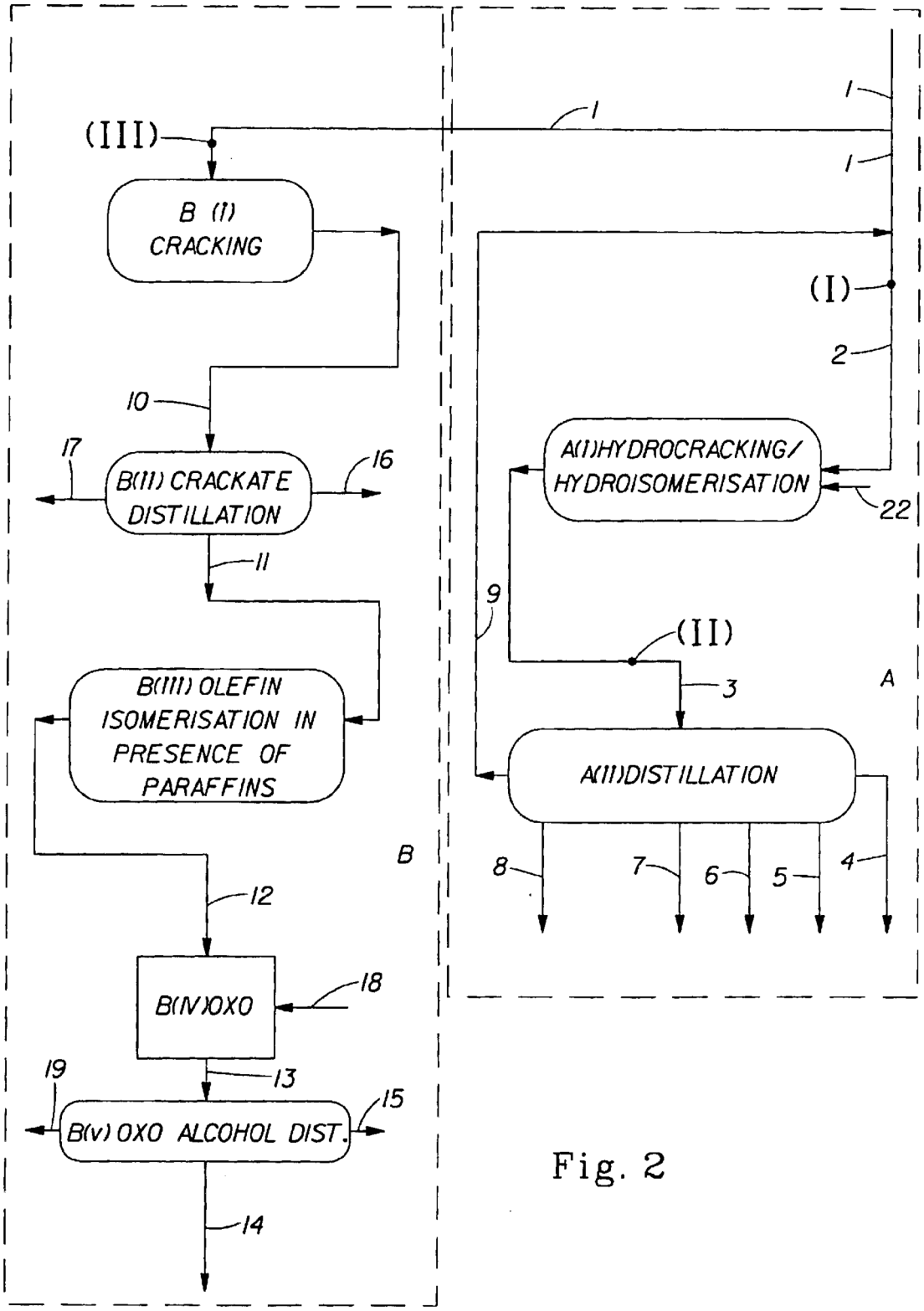
FIG. 2 is a flow diagram representing a process embodiment of the present invention having two process batteries.
Figure 3:
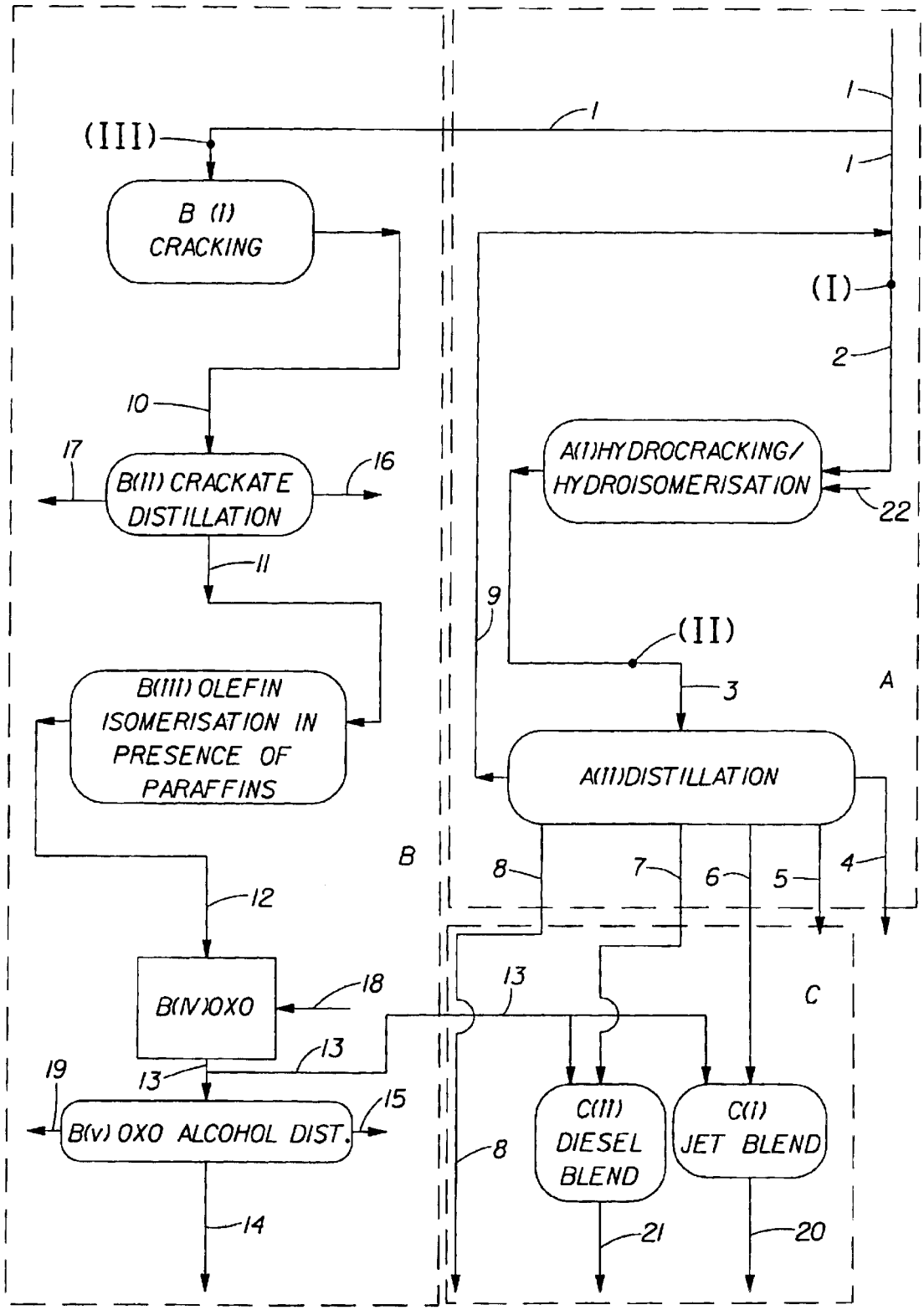
FIG. 3 is a flow diagram representing a process embodiment of the present invention having three process batteries.
Figure 5:
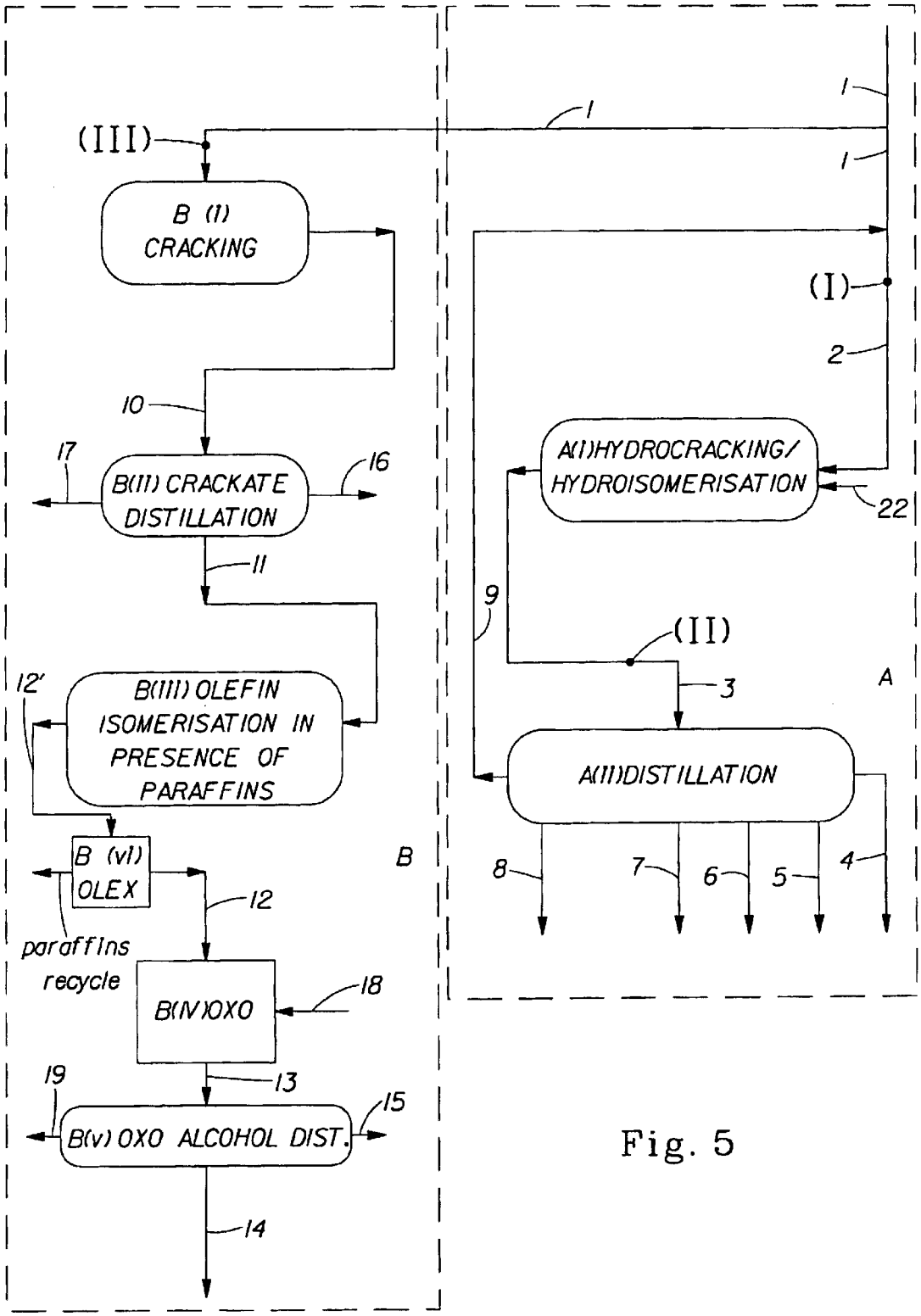
FIG. 5 is a flow diagram representing a process embodiment of the present invention having an olefin/paraffin separator.

Once stream 10 from process unit B(i) has been secured, it is in accordance with the present invention to convert it to nonlinear primary aliphatic Oxo alcohols via, for example, isomerization in process unit or section B(iii), in FIGS. 2, 3 and 5, by means of at least one Oxo reaction step in process unit or section B(iv) in FIGS. 2, 3 and 5, and to further blend these alcohols with fuel hydrocarbons in a variety of different ways, for example as shown in blending battery C of FIG. 3.

Figure 4:
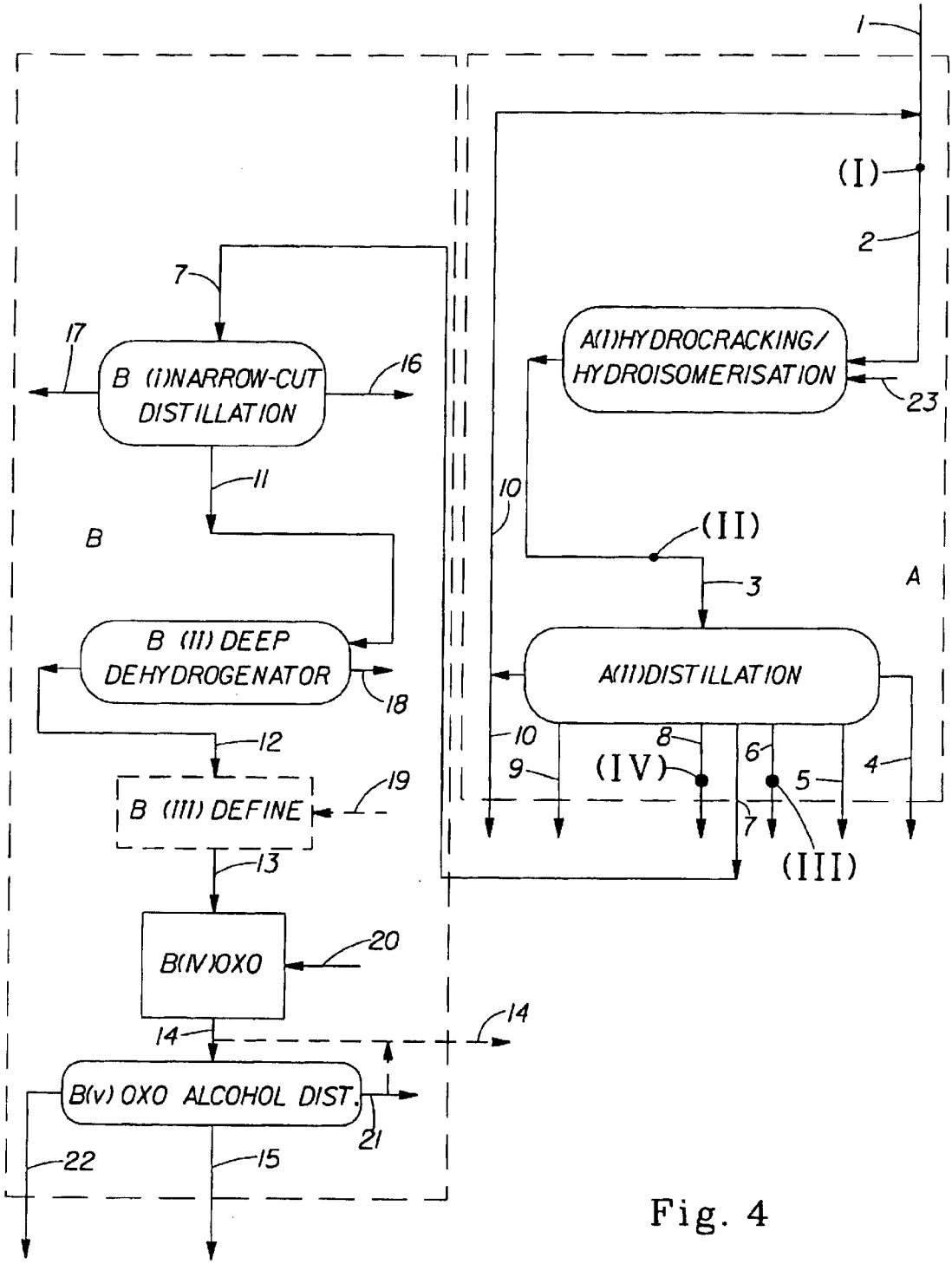
FIG. 4 is a flow diagram representing a process embodiment of the present invention having two process batteries with a distillation unit in one process battery.

Another preferred process embodiment is nonlimitingly illustrated in FIG. 4, which differs from the other Figures in that the offtake from battery A to battery B is from the product distillate tower A(ii), i.e., at the back end of battery A.

Now in more detail with reference to FIG. 2, this shows a configuration in which the crackate stream, 10, is distilled to a narrow-cut, stream 11 in unit B(ii), which is skeletally isomerized (see, for example U.S. Pat. No. 5,589,442 using as catalyst Pt-SAPO or U.S. Pat. No. 5,849,960 using as catalyst Pd/ferrierite of U.S. Pat. No. 5,510,306) in unit B(iii), and the effluent stream, 12, comprising linear paraffins and mid-chain methyl-branched internal olefins, is reacted in a process comprising one or more Oxo steps (unit(s) B(iv)) under conditions in which the hydroformylation reaction occurs preferably at a terminal carbon atom, B(iv) typically also includes means, not shown in the Figures, for reducing intermediate aldehydes to alcohols.

The resulting alcohol-rich stream, 13, in accordance with one embodiment of the invention, comprises a mixture rich in nonlinear primary aliphatic Oxo alcohols and which also contains Fischer-Tropsch Oxo hydrocarbons: the alcohols may be used directly as an additive in jet and/or diesel fuel, or may be distilled to cut out, for example, a mid-chain methyl branched primary detergent alcohol, 14, which can be sold to detergent manufacturers. Note that in the foregoing, Fischer-Tropsch Oxo hydrocarbons present in the alcohol-rich stream 13 can be separated by distillation, resulting in a hydrocarbon-stripped alcohol rich stream 14 and a Fischer-Tropsch Oxo hydrocarbon rich stream 15. This separation is greatly facilitated by the fact that the alcohol has a net gain of one carbon and one oxygen atom as compared to the hydrocarbon. Note also that streams such as 15 or 19, the latter of which also may include olefin dimers and/or diols, can simply be sent back to the main fuel distillation column, e.g., entering battery A at point (II) or battery A at point (I), or can be blended directly into distillate streams. e.g., 4–8. Similarly crackate waste streams 16 and 17 can be sent back to battery A, point (II), for distillation.

FIG. 3 differs from FIG. 2 in that it further nonlimitingly illustrates the detail of a blending battery, C, in which nonlinear primary aliphatic Oxo alcohol-rich stream 13 is blended with jet and/or diesel cuts to produce blend stocks. The blend stocks can be further diluted with fuel hydrocarbons from the present process or from other processes to provide other compositions of the invention, as described in more detail hereinafter.

In FIG. 4, crude F.T. wax 1 combined with a recycle stream 10 pass into a hydrocracking/hydroisomerization reactor as stream 2. Stream 23 is hydrogen. Stream 3 comprising hydrocracked, hydroisomerized hydrocarbons in the form of a broad range and mix of paraffins (e.g., $C_4$–$C_{30}$ including methyl branched compounds) passes to a distillation section of the plant. A(ii). Distillation cuts from this section or the plant include streams suitable for jet 6, and diesel 8. A fraction from within an overall boiling range of C10–$C_{20}$, preferably above $C_{11}$ e.g., $C_{13}$–$C_{16}$, is taken as a side-stream, 7, and is led to battery B for processing into nonlinear primary aliphatic alcohols (NLA's) as further defined elsewhere herein. A first stage in battery B is to secure a relatively narrow (two-carbon to four-carbon) heart cut with sharp boiling point initiation and cut-off. The tops and bottoms, streams 16 and 17, are blended back to appropriate mixing points (I, II, III, and IV) in battery A. The heart cut stream, 11, rich in random methyl-branched paraffins, is dehydrogenated in B(iii) to give a larger than conventional conversion of olefin (typically about 35%) along with some diolefin (up to about 10%). This is illustrative of what can be termed a "deep dehydrogenation" for the present purposes. Exhaust stream 18 carries off hydrogen and any low boiling crackates generated. Stream 12, rich in methyl-branched olefins, is optionally further processed via a diolefin-to-olefin hydrogenator such as a commercial DEFINE® type unit. Stream 12 or 13 carries output from the dehydrogenator, optionally via the DEFINE® hydrogenator, to an Oxo reactor unit or section or the plant, B(iv). In the latter, preferentially, the double bonds of internal olefins present are isomerized to become terminal and are hydroformylated to give a stream 14 comprising nonlinear primary aliphatic alcohols as defined further hereinafter and, as a majority component, methyl branched paraffins suitable for use as fuel F.T. Oxo hydrocarbons, which have been carried through the process. If needed, not shown but included in the Oxo reactor stage B(iv) is a polishing hydrogenation of the inherent intermediate aldehyde-to-alcohol step. Stream 20 is carbon monoxide/hydrogen gas. Crude stream 14 is suitable as a concentrated fuel additive (a "fungible" lubricant additive concentrate i.e., one which is an economically interchangeable "standard material" for commerce), or (optionally as shown in FIG. 4 by the dashed line) for back blending into jet/diesel streams of battery A to form fungible blendstocks or finished fuels. If desired, and as shown in FIG. 4, a further distillation stage B(v) can be used to secure the nonlinear primary aliphatic Oxo alcohols essentially free from fuel hydrocarbons, stream 15, which can be useful, for example, to the manufacturers of detergents or other products. Recovered hydrocarbons 21 can be recycled and bottoms, 22, contain nonlinear diols which can be useful in and of themselves as fuel lubricants, and can be added into appropriate blending streams, or can be useful for other purposes, e.g., in detergents.

FIG. 5 represents a process rather similar to that described in connection with FIG. 2, with the exception or variation that an additional plant section or stage, B(vi) is present which is an olefin/paraffin separator, for example one relying on adsorptive separation on zeolites, e.g., an OLEX® unit. This unit can be used to increase the olefin/paraffin ratio in the stream entering Oxo reactor section B(iv). Thus, specifically, stream 12 in FIG. 5 as it enters the Oxo section B (iv) has a higher olefin/paraffin ratio than does stream 12 in FIG. 2 as it enters the Oxo section B(iv).

Figure 6:
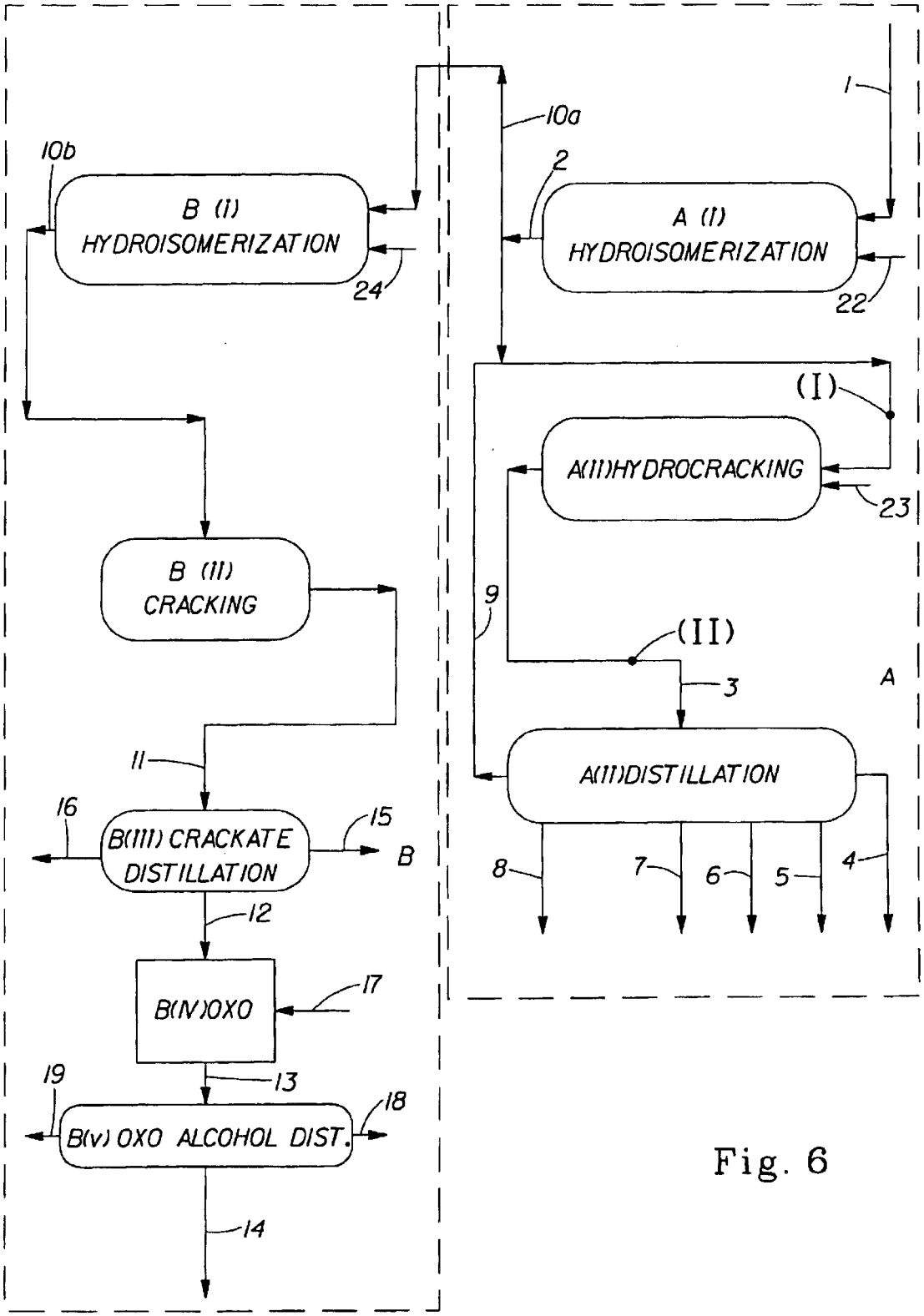
FIG. 6 is a flow diagram representing a process embodiment of the present invention having a wax isomerization unit.

FIG. 6 represents a process that has aspects which are similar to those described in connection with FIG. 2, but also some important differences. A major difference is that isomerization is done as a wax. This requires in additional wax isomerization unit, B(i), the output stream 10*b* from which can be cracked in B(ii) to form highly branched alpha olefins, in stream 11. These are ideal for Oxo reaction by a non-isomerizing Oxo catalyst used in unit or section B(iv). Whereas in FIG. 2, the hydrocracking/hydroisomerization section of battery A is shown as one block, in FIG. 6, A(i) and A (ii) show isolated wax hydroisomerization and hydrocracking.

Preferred processes include those wherein stage (I) above includes providing an F.T. wax and hydroisomerizing/hydrocracking it as shown in battery A of FIGS. 2, 3, and 4. Likewise, preferred processes include those wherein stage (III) above is conducted as shown in the configurations of battery B in FIGS. 2, 3, and 4. Note in particular the Oxo reactor B(iv). With respect to delinearizing, (II) in the above-referenced process, see for example FIG. 2 or 3. It will be seen that these Figures show a pre-Oxo stage of cracking in the absence of added hydrogen in unit B(i) of battery B. This effectively produces chain-breaking and concurrent alpha-olefin formation. Isomerization of the olefins to give the requisite degree of branching, i.e., delinearizing, occurs in unit B(iii) in both of FIGS. 2 and 3. The sum of the cracking in B(i), the crackate distillation in B(ii), and the olefin isomerization in B(iii) accomplish all the needs of the above-identified stage (II), and prepare the product of the first stage for Oxo reaction in unit B(iv). In the discussion above, note that none of the stages, e.g., stage (II), are limited to one specific sequence, for example the sequence of FIG. 2 or 3. Other variations, for example, appear in FIGS. 4 and 6, which effectively also accomplish the needed delinearizing and preparing the product of the first stage for Oxo reaction, involving chain-breaking, branch-forming, and olefin-forming chemical reaction steps.

The present invention is not limited to one or another preferred process, but to further illustrate, the invention also includes a process as illustrated in FIG. 3, for making a fuel composition, said process comprising a step of blending: (a) from about 90% to about 99.9% of fuel hydrocarbons having from about 9 to about 20 carbon atoms (as produced for example from streams 6 or 7 of battery A of FIG. 3 combined with F.T. Oxo hydrocarbons present in stream 13 of battery B); and (b) from about 100 ppm to about 10% of nonlinear primary aliphatic Oxo alcohols (NLA), (as produced for example from stream 13 of battery B of FIG. 3) wherein said (NLA) alcohols are produced by the following stages:

(I) a first stage comprising: providing F.T. wax (stream 1 of FIG. 3), (II) a pre-Oxo stage comprising cracking said F.T. wax (in unit B(i) of FIG. 3) to an alpha-olefin/paraffin mixture (stream 10 of FIG. 3) and distilling the crackate (in B(ii) of FIG. 3) to produce a two-carbon to four-carbon olefin/paraffin cut (stream 11 of FIG. 3) and isomerizing the olefins of said olefin/paraffin cut (in unit B (iii) of FIG. 3) to form $C_1$–$C_3$ alkyl-branched, preferably methyl-branched olefins plus paraffins (stream 12 of FIG. 3); and (III) an Oxo/post-Oxo stage comprising converting the product of the pre-Oxo stage (stream 12 of FIG. 3) to said alcohol, said stage comprising at least one Oxo step with integral inclusion of an Oxo aldehyde to alcohol conversion step (all in B(iv) in FIG. 3). The product from B(iv) (stream 13 in FIG. 3) includes both the nonlinear primary aliphatic Oxo alcohols and one of the components of the final fuel, namely the F.T. Oxo hydrocarbon which is the paraffin referred to supra combined with limited amounts of paraffins produced by reduction in unit B(iv) of the isomerized olefin.

An alternate process for arriving at compositions of the present invention, like others herein, also involves "piggbacking" onto an F.T. plant. See for example stream 4 from Battery A in FIG. 2. The compositions are prepared by using such a stream, rich in propylene/butylene. Thus the fuel compositions herein, for example those for use as jet or diesel fuel, include those which can be described as comprising the product of blending: (a) from about 90% to about 99.9% of fuel hydrocarbons having from about 9 to about 20 carbon atoms; and (b) nonlinear primary aliphatic Oxo alcohols (NLA), wherein said alcohols are the product of a process having: (I) a first stage comprising: providing a member selected from propylene/butylene monoolefin oligomers (optionally further comprising ethylene) having from 0.5 to 2.0 methyl groups per chain, said oligomers being prepared using molecular sieves selected from ZSM-23 and functional equivalents (in a battery not shown in FIG. 2) and (II) an Oxo/post-Oxo stage comprising at least one Oxo step and further optionally comprising an aldehyde to alcohol conversion step. Note that in this instance, the process of forming said component (b) (the NLA) is non-integral with the process of forming said component (a). With reference to FIG. 2, note that the production of component (a) is absent from batteries A and B: it is prepared outside these batteries rather than being integrated into one or both of them.

Other Compositional Limits; Impurities

The present compositions can further be described in conjunction with various compositional limits, including limits on undesirable components or impurities. Compositional limits are described on a finished fuel basis unless otherwise specifically indicated.

Thus the invention includes a fuel composition having (by way of impurities) a non-zero amount, e.g., at least one ppm, of at least one of the following:

from 0% to no more than about 3% olefins: these typically include monoenes, dienes, etc.;

from 0% to no more than about 15% monocyclic aromatics;

from 0% to no more than about 2% $C_1$–$C_9$ carboxylates; and from 0% to no more than 0.5% aldehydes.

All of these can be measured by well known methods, for example carboxylic acid impurities e.g., $C_1$–$C_9$ carboxylates can be measured by ASTM D130 Cu strip corrosion test or variation thereof, see for example U.S. Pat. No. 5,895,506.

Also encompassed is a composition wherein:

said first type of fuel hydrocarbons, (i), comprises from 0% to no more than about 10%, preferably less e.g., up to about 5%, cyclic nonaromatics;

said second type of fuel hydrocarbons, (ii), comprises from 0% no more than about 10%, preferably less e.g., up to about 5% cyclic nonaromatics; and said other type of fuel hydrocarbons, (iii), comprises at least 5% to 20%, more typically at least 10%, cyclic nonaromatics.

The present invention further includes fuel compositions (especially our concentrates) wherein said nonlinear primary aliphatic Oxo alcohols (NLA) are substantially free from methyl butanols, ethylhexanols, propylheptanols, natural alcohol mixtures, substituted and unsubstituted cyclopentylmethanols, substituted and unsubstituted cyclohexylmethanols, aminoalcohols, aromatic alcohols, glycols having linear hydrocarbon chains, alcohols comprising the aldol condensation product of aldehydes; alcohols comprising the Oxo product of linear internal olefins, and alcohols comprising quaternized carbon and consisting of the Oxo product of acid-catalyzed propylene/butylene oligomerization. On the other hand, depending on the source of nonlinear alcohol, varying proportions of these types of impurity compounds, e.g., cyclohexylmethanols, can be present for purposes other than to secure the fundamental lubricity advantages of the NLA alcohols. In the above, the term "substantially free" means that the NLA alcohols in this embodiment comprise less than about 2% by weight of the sum of the above impurity alcohols. More generally the term "substantially free" as applied to an amount of ingredient or impurity means that the ingredient or impurity is present in the composition at levels which are neither useful nor deleterious.

Fuel compositions herein preferably have at most low or zero levels of sulfur and/or nitrogen and/or polycyclic aromatics as analyzed on a finished fuel basis. Preferably said level of sulfur is no more than about 10 ppm, more preferably from 0 ppm to 5 ppm, on a finished fuel basis. Preferably said level of nitrogen is no more than about 50 ppm, more preferably from 0 ppm to at most 20 ppm, on a finished fuel basis. Typically the compositions have a total level of polycyclic aromatics, e.g., alkylnaphthalenes, of from 0 ppm to no more than about 50 ppm on a finished fuel basis. Certain highly preferred compositions are substantially free from olefins and carboxylates.

Other Optional Adjuncts

The invention also encompasses compositions further comprising: (g) from about 0.001 ppm to about 10%, more typically up to about 5%, of a fuel adjunct selected from (I) diesel adjuncts comprising diesel ignition improvers, diesel stability improvers, diesel corrosion inhibitors, diesel detergent additives, diesel cold flow improvers, diesel combustion improvers, other conventional diesel adjuncts, and mixtures thereof, (II) aviation fuel adjuncts comprising jet fuel ignition improvers, jet fuel stability improvers, jet fuel corrosion inhibitors, jet fuel detergent additives, jet fuel cold flow improvers, jet fuel combustion improvers, jet fuel luminosity reducers/radiation quenchers, jet fuel antimicrobial/antifungal adjuncts, jet fuel antistats, other conventional jet fuel adjuncts and mixtures thereof. Such adjuncts are known in the fuel-making art, see for example Kirk Othmer, Encyclopedia of Chemical Technology, Wiley, N.Y., 4th Ed., Vol. 3., pp. 788–812 (1992) and Vol. 12, pp. 373–388 (1994) and references therein. Percentages and proportions can be adjusted within ranges well known to formulators.

Other Embodiments and Ramifications

The invention encompasses concentrated fuel additives, i.e., "concentrates" wherein said fuel hydrocarbons are substantially free from hydrocarbons other than Fischer Tropsch—Oxo hydrocarbons.

The invention further encompasses compositions which are substantially free from native F.T. alcohols. (a "native" F.T. alcohol is an alcohol which is not formed in the Oxo stage of the present type of F.T. followed by Oxo process, but rather, is formed in an F.T. stage without an Oxo: see for example the art in background. A problem with certain art-described processes is an inability to make high levels of a nonlinear alcohol independently from the hydrocarbon compositions.

The invention further encompasses compositions wherein said nonlinear primary aliphatic Oxo alcohols are substantially the only lubricity-improving component.

The invention also encompasses compositions which are substantially free from diols.

Products of the Process in More Detail

The invention encompasses novel mixtures, such the NLA-rich composition of stream 13 (see the FIGS. 2, 3, 5). This composition can, for example, comprise from about 20% to about 65% by weight of NLA alcohols as defined hereinabove; preferably they are the product of substantially all-terminal hydroformylation in the Oxo stage. Depending on the cut taken in crackate distillation B(i) (see the FIGS. 2, 3, 5) and recalling that the Oxo process adds one carbon, the stream 13 alcohols can for example be $C_{12}$–$C_{15}$ primary Oxo alcohols when 13 is to be used in jet fuels, or $C_{14}$–$C_{17}$ primary Oxo alcohols when 13 is to be used in diesel fuels. Very highly preferred NLA alcohols have a high proportion of mid-chain methyl branching, for example substantially all branching may be methyl and not ethyl or higher branching. The composition also comprises less than about 10% of diols, more typically from 1 ppm to about 1% of diols; typically these are branched alpha-omega-primary Oxo diols as defined hereinabove having two more carbon atoms than the diolefin intermediate from which they are derived. The composition may further comprise, for example, from 0% to about 5% of linear primary Oxo alcohols; less than about 0.1%, typically from 0 to 0.01% (or lower, e.g., 0.001% or less) of aldehydes; from about 35% to about 65% of F.T. Oxo hydrocarbons in paraffin form; from 0% to about 1% of F.T. Oxo hydrocarbons in olefin form; from 0% to about 1% of aromatics; less than about 10 ppm, to as low as undetectable amounts of sulfur; and less than about 20 ppm of nitrogen.

Stream 6 is a rather conventional stream but its composition needs to be described so as to further define another novel composition herein, namely blend stock 20. Thus, illustratively and non-limitingly, stream 6 is fuel hydrocarbon, more specifically F.T. non-Oxo hydrocarbons, in the form of a jet cut boiling at from about 320 deg. F. to about 550 deg. F. and comprising at least 95% by weight of the hydrocarbons as paraffins. Stream 6 has an iso- to normal-ratio of about 0.3 to about 3.0 and comprises, for example, at most 10 ppm S and at most 20 ppm N (preferably less than 10 ppm of each); stream 6 comprises at most 1% unsaturates. The novel blend stock, 20, comprises a blend of streams 13 and 6 at a weight ratio of from about 1:1 to about 1:50.

Another novel composition herein is a jet fuel derived from streams 13 and 6, having the form of a mixture of streams 13 and 6 and comprising from about 0.1% to about 5%, more typically from about 0.1% to about 0.5% of alcohols in total; preferably in such compositions, any linear alcohols of stream 13 are present in the final fuel composition at a maximum level of about 1/10 of the total monoalcohols (of 13). Thus the fuel is very rich in the desired mid-chain branched long-chain primary Oxo alcohols (NLA alcohols) and very poor in linear Oxo alcohols.

Another illustrative novel fuel composition herein is substantially free from linear primary Oxo alcohols. Stream 7 is also a rather conventional stream but its composition needs to be described so as to further define yet another composition herein which is novel, namely blend stock 21. Thus, illustratively and non-limitingly, stream 7 is fuel hydrocarbon, more specifically F.T. non-Oxo hydrocarbons, in the form of a diesel cut boiling at from about 320 deg. F. to about 700 deg. F. and comprising at least 95% by weight paraffins. Stream 7 has an iso- to normal-ratio of about 0.3 to about 3.0 and comprises at most 10 ppm S and at most 20 ppm N (preferably less than 10 ppm of each); stream 7 comprises at most 1% unsaturates and has a cetane number of greater than or equal to about 70. The novel blend stock, 21, comprises a blend of streams 13 and 7 at a weight ratio of from about 1:1 to about 1:50. Another novel composition of the invention is a diesel fuel derived from streams 13 and 7, having the form of a mixture of streams 13 and 7 and comprising from about 0.1% to about 1%, more typically from about 0.1% to about 0.5% of alcohols in total; preferably in such compositions, any linear alcohols of stream 13 are present in the final fuel composition at a maximum level of about 1/5 of the total monoalcohols ((a) and (c) of 13). Thus the diesel fuel is rich in the desired mid-chain branched long-chain primary Oxo alcohols (NLA alcohols) and poor in linear Oxo alcohols.

Another illustrative diesel fuel composition is substantially free from linear primary Oxo alcohols. It should be understood and appreciated that the final jet and/or diesel fuel compositions given above are illustrative, thus it is equally possible, though not shown in the Figures, to blend stream 13 or the blend stocks 20 or 21 with hydrocarbons from other processes to complete fuel-making, leading to jet and/or diesel and/or turbine fuels. Such compositions are also believed to be novel and include, for example, from 0.1% to about 5%, more typically from about 0.1% to about 0.5% of the alcohols of 13 in total and, as major source of the hydrocarbons of the fuel, non-F.T., non-Oxo fuel hydrocarbons in the form of hydrodesulfurized and preferably at least partially biodesulfurized hydrocarbons having poor lubricity, e.g., less than about 2500 grams in the scuffing BOCLE test (see, e.g., U.S. Pat. No. 5,814,109). For hydrodesulfurization/biodesulfurization of fuel hydrocarbons, see e.g., U.S. Pat. No. 5,510,265, Oil & Gas Journal, Feb. 22, 1999, pp. 45–48 and Oil & Gas Journal, Apr. 28, 1997, pp. 56-. Other primary sources of non-F.T., non-Oxo fuel hydrocarbons can vary widely and can include, for example, hydrocarbons derived from heavy stocks by ring-opening of cyclohexyl- and/or cyclopentyl-moieties.

Compositions are likewise encompassed wherein said nonlinear primary aliphatic Oxo alcohols (NLA) and said second type of fuel hydrocarbons have independently varying numbers of carbon atoms and degrees of branching. Degree of branching is defined and discussed hereinabove. Further, to better understand this aspect of the invention, refer to FIG. 2. In FIG. 2, the degree of branching of the second type of fuel hydrocarbons is determined in process section A(i). These fuel hydrocarbons are separated by boiling-point in process section A(ii). This provides control of the number of carbon atoms. For the NLA alcohols, their degree of branching is determined by the aggregate effect of process sections B(iii) and B(iv). Their boiling point is a consequence of process section B(ii).

Also included are compositions wherein said second type of fuel hydrocarbons has a broader range of number of carbon atoms than said nonlinear primary aliphatic Oxo alcohols. This aspect of the invention can likewise be understood by reference to the nonlimiting illustrations in the Figures. This aspect is a matter of choice, made possible by the independence of batteries A and B. The choice of broad range, for example, for economic reasons, is thereby made possible.

In certain preferred compositions, said second type of fuel hydrocarbon has a lesser degree of branching than said nonlinear primary aliphatic Oxo alcohols, preferably by at least 0.2 mole fraction. For example, so as to secure diesel fuel compositions wherein the cetane number is maximized while the low temperature fluidity is superior compared to art-used linear alcohols, one would like to minimize the degree of branching in the fuel hydrocarbon, since linear paraffins have a higher cetane value than the corresponding branched paraffins. Using our invention, therefore, battery A production of fuel hydrocarbons permits the isolation of desirably linear (low branching) paraffins, while battery B permits the introduction of sufficient and somewhat higher branching (compared to the corresponding paraffins) into the alcohols to achieve superior low temperature properties. An analogous situation obtains for jet fuel, except that smoke point replaces cetane number as the second controlled parameter.

Method and Use Embodiments

The present invention has numerous method and use embodiments, which can be dependent on or independent from the process by which the compositions supra are made. Thus the invention includes all use of branched long-chain primary Oxo alcohols, preferred types being preferred NLA as described above, as low-temperature and/or lubricity-improving additives for fuels, more particularly jet, diesel or turbine fuels; use of branched long-chain primary Oxo alcohols in intermediate compositions or blend-stocks for such fuels; and various more specific uses, e.g., use of branched long-chain primary Oxo alcohols in fuels for automobile diesel engines, especially new, small diesel engines under development. The corresponding uses of compositions such as stream 13, defined as product of the present processes, is likewise encompassed.

In the use embodiments of the invention, there is encompassed herein use of any of the herein identified compositions as a dual-use jet/diesel concentrated additive or blend stock.

Also encompassed is a method of use of any of the compositions comprising a step of combusting the same, as fuel in a jet engine or in a compression ignition engine, e.g., a diesel engine.

Further encompassed is a method of use of any of the identified compositions comprising a step of combusting said composition as fuel in a vehicle having a power system consisting of a 10,000 psi or greater direct injection diesel engine, preferably of the common rail type, or a hybrid power system comprising said engine and an electric motor. In a preferred method, the method additionally comprises a step of storing said composition in a tank and a step of passing said composition from said tank to said engine, wherein said method, said composition is pumpable at temperatures down to about −25 deg. C., or lower.

In addition, the invention includes a method of use of a composition of the invention, comprising a step of passing said composition from a fuel tank at temperatures down to about −47 deg. C., or lower, to a jet engine followed by a step of combusting said composition as fuel in said jet engine at elevated altitudes and/or at low ambient temperatures.

The methods herein further include a method of biodegrading a fuel comprising (i) selecting a composition of the invention; and (ii) disposing of said composition, optionally in presence of soils and/or microorganisms. This method is envisaged in view of the fact that persons using the invention may suffer occasional, accidentals spills, leaks etc. and/or may wish to make use of environmental services companies, or the like, to dispose of unwanted or at least unrecoverable fuel compositions in accordance with the invention. The present fuels can be conveniently disposed of in any permitted manner or location where biodegradation of the undesired composition may proceed. Unlike oxygenates such as MTBE, the present NLA alcohols have low water solubility and are biodegradable. Moreover the present NLA alcohols have excellent low toxicity. These properties are helpful in widely used fuels.

Further the invention envisages use of fuel compositions of the invention as fuel for an engine selected from two-cycle and four-cycle engines having a compression ratio of from 5:1 to 40:1; or as fuel in jet or turbine engines utilizing flame or surface combustion.

The invention further includes a method of transporting a composition of the invention, comprising pumping said composition in a pipeline under low ambient temperature conditions, e.g., extreme arctic conditions.

The present invention has numerous other emobidments and ramifications, including compositions which are not necessarily optimal in terms of performance. For example, the NLA component of the present compositions can comprise $C_{18}$ NLA in combination with one or more other NLA alcohols, for example from a four-carbon cut which includes $C_{16}$ NLA or $C_{17}$ NLA.

Advantages

The present invention has numerous advantages. It allows transportation of concentrates as pumpable homogeneous liquids from a few purpose-built plants to supply worldwide clean jet/diesel needs. Since certain process streams herein can also be used for detergents, the invention has the potential to make all manner of cleaning compositions using derivatives from these streams more affordable for the consumer.

The new processes herein are simple and can use known process units, with a need only to connect or configure them in the novel ways taught herein. The processes thus require a minimum of additional new process development and are very practical. Unexpected process unit combinations herein include piggyback cracking (based on very old detergent art) on processes having modern hydrocracking/hydroisomerization (based on recent lubricant-making art, see for example S. J. Miller, Microporous Materials, Vol. 2 (1994), pp. 439–449.

The processes of the present invention utilize what are potentially the best and largest commercial sources of mid-chain methyl-branched paraffins worldwide, and flexibly accommodate the use of leading-edge technologies for making the main stream. There is little or no waste, since all byproducts from the side-stream(s) can be used or returned to the main stream of the fuel plant at a value equal or greater than on receipt.

Preferred embodiments of the process, which include F-T paraffin making in the main stream of the fuel plant, have an Oxo reaction which can use substantially the same synthesis gas or $H_2$/CO ratio as the F-T paraffin making. The compositions produced have numerous advantages. The products of the present processes are unexpectedly superior for improving low temperature properties and fuel lubricity, permitting clean (low S,N) fuels yet having them be effective in the lubrication of fuel injectors and pumps. The NLA alcohols in the present compositions indeed have excellent surface properties at metal surfaces of components of internal combustion engines, especially in frictionally affected situations.

Most importantly, the specific long-chain branched primary Oxo alcohols produced herein have excellent low-temperature properties and significant lubricity-enhancing power for jet, diesel and turbine fuels, superior to that of linear alcohols known as fuel additives. This is very important in view of various technological and environmental pressures to remove the inherent sulfur-based, nitrogen-based and aromatic based lubricity improvers from such fuels.

Moreover the present long-chain branched primary Oxo alcohols are especially useful for use in new, cleaner, small diesel engines being developed for use in automobiles. Thus, not only in its process embodiments, but also in its composition and method of use embodiments as described below, the present invention has high and significant value.

What is claimed is:

1. A fuel composition for internal combustion engines, said fuel composition comprising:

(a) at least 5% of fuel hydrocarbons and (b) at least 10 ppm of nonlinear primary aliphatic Oxo alcohols having at least 11 carbon atoms, wherein at least 0.6 weight fraction of said nonlinear primary aliphatic Oxo alcohols comprise at least one $C_1$–$C_3$ alkyl substituent situated on a third or higher carbon atom counting from an Oxo alcohol hydroxy group and not more than 0.02 weight fraction of said nonlinear primary aliphatic Oxo alcohols comprises a quaternary substituted carbon atom; wherein components (a) and (b) are cosynthesized.

2. A composition according to claim 1 wherein:

said fuel hydrocarbons comprise at least two types of fuel hydrocarbons, wherein said at least two types of fuel hydrocarbons are differentiated in that at a first type of fuel hydrocarbon is present which is selected from Fischer-Tropsch Oxo hydrocarbons and in that a second type of fuel hydrocarbon is present which is other than said first type of fuel hydrocarbon.

3. A composition according to claim 1 wherein said composition further comprises a member selected from the group consisting of:

(c) linear long-chain monoalcohols;

(d) nonlinear diols;

(e) linear diols; and (f) mixtures of two or more of (c)–(e).

4. A composition according to claim 2 wherein the composition comprises from 20% to 95% of said nonlinear primary aliphatic Oxo alcohols;

and wherein at least 0.8 weight fraction of said nonlinear primary aliphatic Oxo alcohols comprise at least one $C_1$–$C_3$ alkyl substituent situated on a third or higher carbon atom counting from an Oxo alcohol hydroxy group; and not more than 0.01 weight fraction of said nonlinear primary aliphatic Oxo alcohols comprises a quaternary substituted carbon atom.

5. A composition according to claim 1 wherein said fuel hydrocarbons, (a), comprise:

(i) from 0.05% to 18% of a first type of fuel hydrocarbons selected from Fischer-Tropsch Oxo hydrocarbons and (ii) from 80% to 99% of a second type of fuel hydrocarbons selected from Fischer-Tropsch non-Oxo hydrocarbons;

wherein said second type of fuel hydrocarbons and said first type of fuel hydrocarbons are present in a ratio of at least 10:1 by weight.

6. A composition according to claim 2 wherein said fuel hydrocarbons, (a), comprise:

(i) from 0.005% to 12% of a first type of fuel hydrocarbons selected from Fischer-Tropsch Oxo hydrocarbons;

(ii) from 0% to 99.8% of a second type of fuel hydrocarbons selected from Fischer-Tropsch non-Oxo hydrocarbons; and (iii) from 0.1% to 99.995% of at least one other type of fuel hydrocarbons selected from fuel hydrocarbons other than (i) and (ii);

wherein the said at least one other type of fuel hydrocarbons comprises at least 0.1 weight fraction saturated cyclic hydrocarbons; and all other types of fuel hydrocarbons present comprise less than 0.05 weight fraction of saturated cyclic hydrocarbons, wherein said other type, (iii), of fuel hydrocarbons and said first type of fuel hydrocarbons are present in a ratio of at least 10:1 by weight.

7. A composition according to claim 2 wherein said fuel hydrocarbons comprise from 10 to 20 carbon atoms; and said composition comprises a flow point of −25 deg. C. or below;

a sulfur content of less than 50 ppm; and an aromatics content of less than 10% and said composition comprises:

(a) at least 90% of said fuel hydrocarbons; and (b) from 100 ppm to 5% of said nonlinear primary aliphatic Oxo alcohols having from 11 to 21 carbon atoms.

8. A composition according to claim 2 wherein said fuel hydrocarbons comprise from 9 to 14 carbon atoms; and wherein said composition comprises a flow point of −47 deg. C. or below; and a smoke point of at least 18 mm wick; and wherein said composition comprises:

(a) at 90% of said fuel hydrocarbons; and (b) from 100 ppm to 5% of said nonlinear primary aliphatic Oxo alcohols having from 11 to 17 carbon atoms.

9. A composition according to claim 2 wherein said fuel hydrocarbons comprise from 5 to 14 carbon atoms; and said composition has a flow point of −25 deg. C. or below, a sulfur content of less than 50 ppm; and an aromatics content of less than 10%; and wherein said composition comprises:

(a) at least 90% of said fuel hydrocarbons; and (b) from 100 ppm to 10% of said nonlinear primary aliphatic Oxo alcohols.

10. A composition according to claim 1 wherein said nonlinear primary aliphatic Oxo alcohols have the formula:

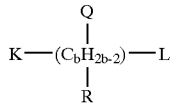

wherein $C_bH_{2b-2}$ is a linear saturated hydrocarbyl and K, L, Q and R are substituents;

K is $CH_3$, L is the moiety:

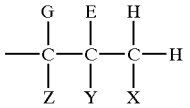

wherein one of X and Y and Z is $CH_2OH$; and any of X and Y and Z which is not $CH_2OH$ is H;

b is an integer selected such that the total carbon content of said nonlinear primary aliphatic Oxo alcohol is from 11 to 21;

E, G and Q are selected from H, methyl, ethyl, propyl and butyl provided that at least one of E, G and Q is not H;

and R is selected from H, methyl, ethyl, propyl and butyl.

11. A composition according to claim 3 wherein said nonlinear diols have the formula:

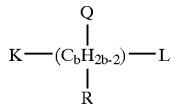

wherein $C_bH_{2b-2}$ is a linear saturated hydrocarbyl and K, L, Q and R are substituents; K and L are independently selected from:

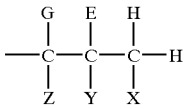

wherein one of X and Y and Z is $CH_2OH$; and any of X and Y and Z which is not $CH_2OH$ is H; b is an integer selected such that the total carbon content of said nonlinear diol is from 12 to 22;

E, G and Q are selected from H, methyl, ethyl, propyl and butyl provided that at least one of E, G and Q is not H; and R is selected from H and methyl.

12. A composition according to claim 1 further comprising a non-zero amount of at least one of the following components:

from 0% to no more than 3% olefins;

from 0% to no more than 15% monocyclic aromatics;

from 0% to no more than 2% $C_1$–$C_9$ carboxylates; and from 0% to no more than 0.5% aldehydes.

13. A composition according to claim 6 wherein:

said first type of fuel hydrocarbons, (i), comprises from 0% to no more than 10% cyclic nonaromatics;

said second type of fuel hydrocarbons, (ii), comprises from 0% no more than 10% cyclic nonaromatics; and said other type of fuel hydrocarbons, (iii), comprises at least 5% cyclic nonaromatics.

14. A composition according to claim 1 wherein said nonlinear primary aliphatic Oxo alcohols are substantially free from methyl butanols, ethylhexanols, propylheptanols, natural alcohol mixtures, aminoalcohols, aromatic alcohols, glycols having linear hydrocarbon chains, alcohols comprising the aldol condensation product of aldehydes; alcohols comprising the Oxo product of linear internal olefins, and alcohols comprising quaternized carbon and consisting of the Oxo product of acid-catalyzed propylene/butylene oligomerization.

15. A composition according to claim 3 wherein said nonlinear primary aliphatic Oxo alcohols are substantially free from methyl butanols, ethylhexanols, propylheptanols, natural alcohol mixtures, aminoalcohols, aromatic alcohols, glycols having linear hydrocarbon chains, alcohols comprising the aldol condensation product of aldehydes; alcohols comprising the Oxo product of linear internal olefins, and alcohols comprising quaternized carbon and consisting of the Oxo product of acid-catalyzed propylene/butylene oligomerization.

16. A composition according to claim 6 wherein said nonlinear primary aliphatic Oxo alcohols are substantially free from methyl butanols, ethylhexanols, propylheptanols, natural alcohol mixtures, aminoalcohols, aromatic alcohols, glycols having linear hydrocarbon chains, alcohols comprising the aldol condensation product of aldehydes; alcohols comprising the Oxo product of linear internal olefins, and alcohols comprising quaternized carbon and consisting of the Oxo product of acid-catalyzed propylene/butylene oligomerization.

17. A composition according to claim 1 wherein said composition is in the form of a concentrated fuel additive and wherein said fuel hydrocarbons are substantially free from hydrocarbons other than Fischer-Tropsch—Oxo hydrocarbons.

18. A composition according to claim 1 wherein said composition is substantially free from native F.T. alcohols.

19. A composition according to claim 1 wherein said nonlinear primary aliphatic alcohols are monohydric.

20. A composition according to claim 1 that is substantially free from diols.

21. A composition according to claim 1 wherein said composition further comprises: (c) from 0.001 ppm to 30% of linear $C_{11}$ to $C_{21}$ alcohols.

22. A composition according to claim 3 comprising:

(d) from 0.001 ppm to 30% of $C_{12}$ to $C_{22}$ nonlinear primary aliphatic diols.

23. A composition according to claim 3 comprising (e) from 0.0001 ppm to 3% of $C_{12}$ to $C_{22}$ linear primary aliphatic diols.

24. A composition according to claim 3 comprising (f) from 0.001 ppm to 30% of a mixture of members selected from:

linear $C_{11}$ to $C_{21}$ monoalcohols; $C_{12}$ to $C_{22}$ nonlinear primary aliphatic diols; and $C_{12}$ to $C_{22}$ linear primary aliphatic diols.

25. A composition according to claim 1 further comprising:

(g) from 0.001 ppm to % of a fuel adjunct selected from (I) diesel adjuncts comprising diesel ignition improvers, diesel stability improvers, diesel corrosion inhibitors, diesel detergent additives, diesel cold flow improvers, diesel combustion improvers, other conventional diesel adjuncts, and mixtures thereof; or (II) aviation fuel adjuncts comprising jet fuel ignition improvers, jet fuel stability improvers, jet fuel corrosion inhibitors, jet fuel detergent additives, jet fuel cold flow improvers, jet fuel combustion improvers, jet fuel luminosity reducers/radiation quenchers, jet fuel antimicrobial/antifungal adjuncts, jet fuel antistats, other conventional jet fuel adjuncts and mixtures thereof.

26. A composition according to claim 11 wherein said nonlinear diols are nonlinear Oxo diols, and wherein when Q and R are both different from H, Q and R are attached to different carbon atoms of said linear saturated hydrocarbyl.

27. A composition according to claim 1 wherein said composition comprises from 0.2% to 19% of said nonlinear primary aliphatic Oxo alcohol and from 81% to 99.8% of said fuel hydrocarbons; wherein said nonlinear primary aliphatic Oxo alcohols have an independently variable degree of branching, $DOB_a$, which exceeds the degree of branching of said fuel hydrocarbons, $DOB_F$, according to the relation: $DOB_a=DOB_F+0.3$.

28. A composition according to claim 1 wherein said composition comprises from 5% to 90% of said fuel hydrocarbons and from 10% to 95% of said nonlinear primary aliphatic Oxo alcohol; wherein said fuel hydrocarbons are derived from Fischer Tropsch wax, petroleum wax and mixtures thereof, and said nonlinear primary aliphatic Oxo alcohol is in the form of a two-carbon alcohol cut selected from a C12–C13 cut, a $C_{14}$–$C_{15}$ cut and a $C_{16}$–$C_{17}$ cut.

29. A composition according to claim 1 wherein said composition comprises from 55 to 90% of said fuel hydrocarbons and from 10% to 95% of said nonlinear primary aliphatic Oxo alcohol wherein said fuel hydrocarbons are derived from Fischer Tropsch wax, petroleum wax and mixtures thereof, and said nonlinear primary aliphatic Oxo alcohol is in the form of a four-carbon alcohol cut selected from a $C_{14}$–$C_{17}$ cut.

30. A composition according to claim 10 wherein when Q and R are both different from H, and Q and R are attached to different carbon atoms of said linear saturated hydrocarbyl.

31. A composition according to claim 10 wherein said nonlinear primary aliphatic Oxo alcohols have the formula:

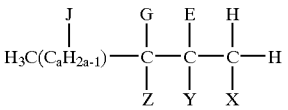

wherein one of X and Y and Z is $CH_2OH$;

any of X and Y and Z which is not $CH_2OH$ is H;

E, G and J are selected from H and methyl provided that at least one of E, G and J is methyl; the moiety $C_aH_{2a-1}$ is a linear saturated hydrocarbyl; and a is an integer selected such that the total carbon content of said nonlinear primary aliphatic Oxo alcohol is from 11 to 21.

32. A composition according to claim 15 wherein said nonlinear diols are nonlinear Oxo diols, and wherein when Q and R are both different from H, Q and R are attached to different carbon atoms of said linear saturated hydrocarbyl.

33. A composition according to claim 3 comprising nonlinear diols, wherein said nonlinear primary aliphatic Oxo alcohols, (b), and said nonlinear diols, (d), are present at a ratio (b):(d), of from 1000:1 to 2:1 by weight.

34. A composition according claim 33 wherein said nonlinear diols are present at a level of from 0.001 ppm to 30% by weight.

* * * * *

UNITED STATES PATENT AND TRADEMARK OFFICE

CERTIFICATE OF CORRECTION

PATENT NO. : 6,896,708 B2
DATED : May 24, 2005
INVENTOR(S) : Conner et al.

It is certified that error appears in the above-identified patent and that said Letters Patent is hereby corrected as shown below:

Title page,
Insert Item: -- [30] Foreign Application Priority Data

Feb. 13, 2001 [WO] WIPO .. PCT 01/04693 --.

Signed and Sealed this

Twenty-fourth Day of January, 2006

JON W. DUDAS
*Director of the United States Patent and Trademark Office*